US010919057B2

(12) United States Patent
Walsh et al.

(10) Patent No.: US 10,919,057 B2
(45) **Date of Patent: *Feb. 16, 2021**

(54) FLOW CONTROL DEVICES AND RELATED SYSTEMS

(71) Applicant: Elliptic Works LLC, Southampton, NY (US)

(72) Inventors: Sean Walsh, Westhampton, NY (US); John Bouvier, Westhampton, NY (US)

(73) Assignee: ELLIPTIC WORKS, LLC, Southampton, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/416,890

(22) Filed: May 20, 2019

(65) Prior Publication Data

US 2019/0270098 A1 Sep. 5, 2019

Related U.S. Application Data

(62) Division of application No. 14/927,391, filed on Oct. 29, 2015, now Pat. No. 10,335,808.

(60) Provisional application No. 62/072,128, filed on Oct. 29, 2014.

(51) Int. Cl.

| | |
|---|---|
| ***B05B 1/30*** | (2006.01) |
| ***E04H 4/16*** | (2006.01) |
| ***B05B 7/04*** | (2006.01) |

(52) U.S. Cl.

CPC ..... *B05B 1/30* (2013.01); *B05B 7/04* (2013.01); *E04H 4/169* (2013.01)

(58) Field of Classification Search

CPC ..... B05B 1/30; B05B 7/04; E04H 4/169
USPC ..... 4/490, 492
See application file for complete search history.

(56) References Cited

U.S. PATENT DOCUMENTS

| | | | | |
|---|---|---|---|---|
| 5,251,343 | A * | 10/1993 | Goettl | E04H 4/169 4/490 |
| 5,992,763 | A * | 11/1999 | Smith | B05B 1/02 239/428.5 |
| 10,335,808 | B2 * | 7/2019 | Walsh | B05B 1/30 |
| 2013/0061383 | A1 * | 3/2013 | Hartmann | E04H 4/169 4/492 |

* cited by examiner

*Primary Examiner* — Tuan N Nguyen
(74) *Attorney, Agent, or Firm* — Offit Kurman, PA; Gregory A. Grissett

(57) ABSTRACT

A flow control device includes a body having an inner and an outer surface that oppose each other. The body may have a first opening and a second opening spaced from the first opening along a first axis. The inner surface may define a passage that extends from the first opening to the second opening along the first axis. The body may also include an inlet port between the first opening and the second opening, and a constriction in the passage between the first opening and the second opening. The flow control device may also comprise a nozzle disposed at least partially in the inlet port and extend at least partially across the passage along a second axis that is angularly offset with respect to the first axis. The nozzle may define an exit port in the passage.

29 Claims, 19 Drawing Sheets

FLOW CONTROL DEVICES AND RELATED SYSTEMS

CROSS-REFERENCE TO RELATED APPLICATIONS

The present application is a divisional application of U.S. application Ser. No. 14/927,391, filed Oct. 29, 2015, which claims priority to and the benefit of U.S. Provisional Application No. 62/072,128, filed on Oct. 29, 2014, the entire contents of each application listed in this paragraph are herein incorporated by reference.

TECHNICAL FIELD

The present disclosure relates to a flow control device and related systems.

BACKGROUND

Fluid control is important in a number of applications where one or more fluids are being mixed together. Industrial processes, such as paper production and compounding of consumer care products, rely on fluid control and circulation managements to help attain intended product attributes. Other applications, such as waste water treatment, fuel injectors, small scale power generators, and pool filtration and cleaning systems, are a few other examples where fluid control is important. Recent work in improving energy consumption in pool systems has placed greater emphasis on fluid management in pool systems.

Pool systems include a pump, a filter, a number of return lines that terminate at returns or return jets, a skimmer, and a main drain. The pump will pull water from the pool through a skimmer, or main drain. The water is passed through a filter and then filtered water is returned to the pool under pressure through a variety of returns that control flow direction and flow rate. Returns are also referred to as pool jets and are generally mounted on the pool wall below the surface. The water is returned to the pool through the pool jets to create circulation and mixing of the pool water. Under normal conditions it is expected to run a system until at least one turnover of the pool's water is achieved. Turnover is the amount of time it takes a pool system to circulate the volume of water in a given pool. The turnover time is dependent on how fast the pump is able to circulate water, typically measured in gallons per minute (gpm) and the volume of the pool water. For example, a pump that runs at 20 gpm can circulate a 12,000 gallon pool completely in 10 hours. In this example, a turnover rate in 20 hours is 2. In many cases, not all of 12,000 gallons of water will actually pass through the filter. The amount of water that is actually passed through the filter in turnover is dependent on how well the pool water itself is circulated. It is estimated that in the first turnover, only about 40% of the water actually passes through the filter. As the turnover rate increases, the percentage of water that passes through the filter drastically improves to a point, wherein further turnovers do not increase the percentage of filter water appreciably. It is believed that after 4 turnovers, the amount of water that passed through the filter is upwards of 98% of the total pool volume. Until recently, pool system efficiency was not a concern within the pool industry. There is a trend in the pool industry is toward increasing efficiency.

Pool jet returns are critical to pool water circulation and cleaning. There are three type of returns typically used in pool systems: 1) pool jets that face up toward the surface to skim the surface, 2) downward facing jets that face down for cleaning and mixing, and 3) cleaning heads that clean the lower surface of the pool and aid in cleaning and mixing. Each have pros and cons, but all three returns offer limited or poor circulation efficiency. In all cases, however, return water is forced through a nozzle that directs flow and controls flow rates based on the diameter through which the return water passes.

Upward facing return jets are better suited for pools situated in areas where there is a lot of surface debris. The upward facing jet can "push" any floating debris toward the skimmers. The less material sitting on the floor of the pool, the cleaner the pool will be, and the lower amount of chemicals are required to maintain it. Such returns, however, provide poor circulation. With the skimmer pulling water from the surface and the pool jet returning water to the surface, very little circulation occurs in the deeper parts of the pool. This creates dead zones as well as layering of the pool water. The cold water will sit near the bottom of the pool while the warmer water will sit at the surface. When a heater is being used, this can create uneven heating. Furthermore, layering can result in longer heating times to achieve desired pool temperature. With the jet return facing up, surface area is increased through creation of ripples in the pool, creating faster rates of evaporation and heat loss, resulting in more water and heater usage.

Downward facing jets are better suited for pools in an area where very little debris material enters the pool from above. A downward facing jet, or down-jet, provides a high degree of circulation. The skimmers pull water from the surface and redistribute it downwards towards the pool bottom through the return jet. Down-jets also improve heating efficiency and reduce temperature layering in the pool by mixing warmer surface water with cooler water at the bottom. Since the heated water is not at the surface, there is a reduction of heat loss caused by surface interaction and evaporation. Down-jets do not eliminate all temperature layering. The water closer to the surface, heated by the sun, will tend to create a boundary layer of warm water. A boundary layer of warm water at the surface would suggest that surface water is not circulating within the pool system as well as it could, reducing turnover efficiency.

Pop-up cleaning heads are located along the lower surface of the pool. The pop-up heads are coupled to return lines and are typically designed to all return water to flow along the lower pool surface. Pop-up heads are normally flush with the mount structure and pool surface. At certain intervals when return water is passed through the return lines, the flow of return water cause the pop-up heads to actuate, raising a nozzle just above the lower surface of the pool. Some designs may rotate so as to distribute the return flow across a wider arc along the surface the pool. Pool systems with sets of pop-up heads can help improve circulation and push debris from the pool bottom into circulation path toward the surface where the skimmer captures the debris and directs it toward the filter.

SUMMARY

An embodiment of the present disclosure is a flow control device. The flow control device includes a body having an inner and an outer surface that oppose each other. The body may have a first opening and a second opening spaced from the first opening along a first axis. The inner surface may define a passage that extends from the first opening to the second opening along the first axis. The body may also include an inlet port between the first opening and the second opening, and a constriction in the passage between the first opening and the second opening. The flow control device may also comprise a nozzle disposed at least partially in the inlet port and extend at least partially across the passage along a second axis that is angularly offset with respect to the first axis. The nozzle may define an exit port in the passage. The nozzle may be configured to direct a flow of fluid from the inlet port through the exit port toward the second opening of the body along the first axis.

Another embodiment of the present disclosure is a method of controlling flow of a fluid. The method may include the step of positioning a flow control device within a first fluid. The flow control device may have a passage and a port open to the passage. The method may further comprise a step of causing a second fluid to pass through the port into the passage so as to pull an amount of the first fluid external to the flow control device through the passage such that the first and second fluids intermix and exit the device.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown. In the drawings.

DETAILED DESCRIPTION OF ILLUSTRATIVE EMBODIMENTS

Embodiments of the present disclosure include a flow control device, related systems and related methods for controlling the flow of multiple fluids or fluid from multiple sources. In accordance with an embodiment, the fluid flow control device is configured for use in a pool filtration system as further detailed below. In investigating the circulation of the fluids in pool filtration, the flow control device is effective as a down-jet return, nozzle assembly in a pop-up head, or other return jets in a pool system. The flow control device is also effective in fluid mixing operations. Accordingly, while some emphasis is placed on the implementation of the flow control device in pool applications, the flow control device has other applications, including but not limited to, waste water treatment, fluid mixing applications (fluid tanks, aeration, circulation, cleaning), propulsion, power generation (e.g. low hertz flutter for piezo/alternative energy harvesting), and any processes whereby mixing of Newtonian fluids and non-Newtonian fluids is a component.

Figure 1:
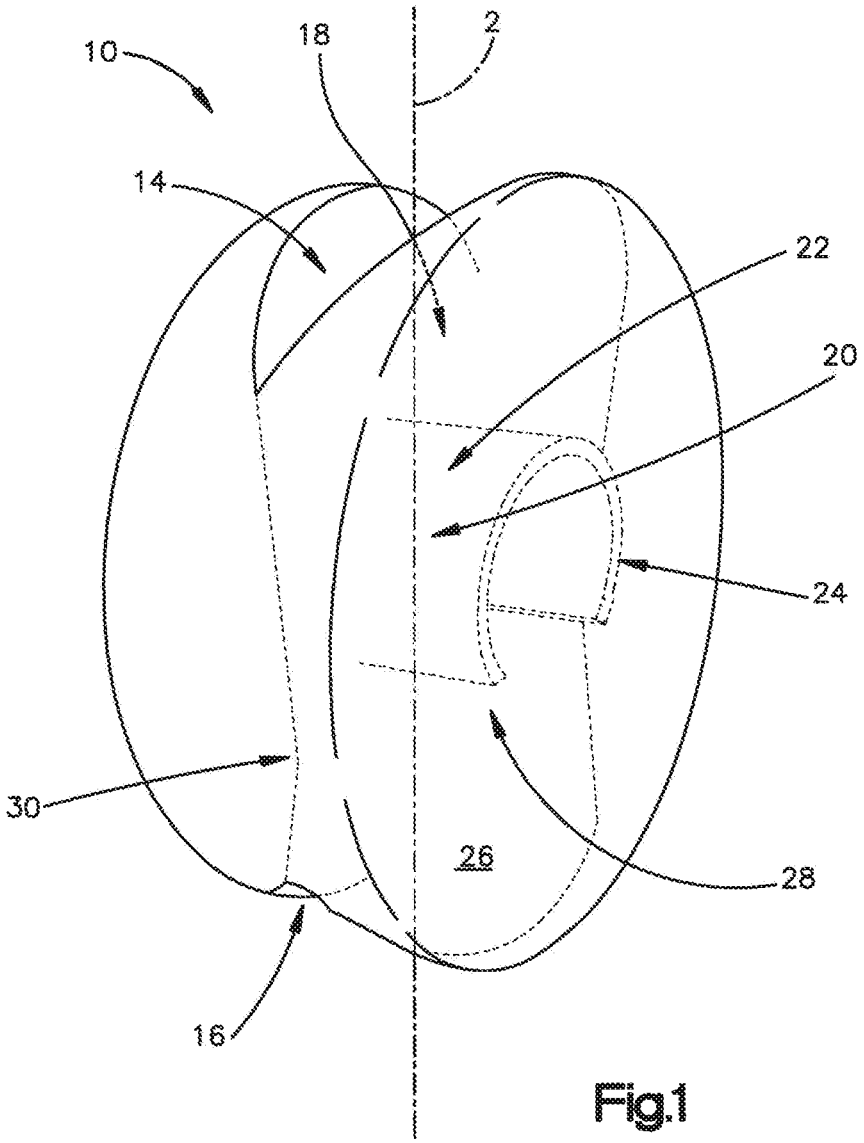
FIG. 1 is a rear perspective view of a flow control device according to an embodiment of the present disclosure.
Figure 2:
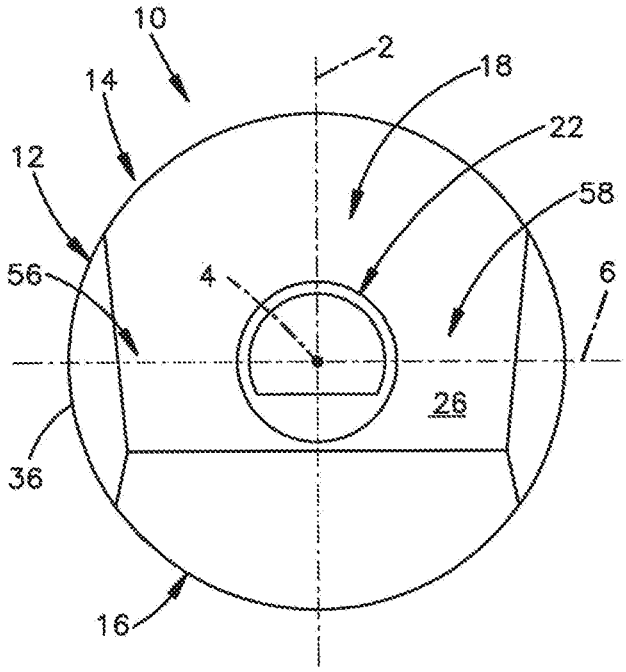
FIG. 2 is a rear view of the flow control device illustrated in FIG. 1.

As shown in FIGS. 1 and 2, a fluid flow control device 10 includes a body 12, a first opening 14, a second opening 16, and a passage 18 that extends from the first opening 14 to the second opening 16 along a central axis 2. The flow control device illustrated in FIG. 1 has a disc-shaped body. The central axis 2 is centrally disposed along the passage 18. The flow control device 10 includes a third opening 20 disposed between the first and second openings 14 and 16. A discharge nozzle 22 is disposed in the inlet opening 20 and extends at least partially across the passage 18 so as to define bypass channels 56 and 58 on either side of nozzle 22. The discharge nozzle 22 includes an entry port 24 at the outer surface 26 of the body 12 and an exit port 28 disposed inside the passage 12. The passage 18 includes a constriction 30 that, as illustrated, is located proximate the exit port 28 of the nozzle 22. In certain embodiments, the passage as an elliptical shape. As used in the present disclosure, the first opening 14 may be referred to as an intake opening. The second opening 16 may be a discharge opening through which fluid flow from the nozzle 22 and intake opening exits the flow control device 10. The third opening 20 may be referred to as an inlet opening through which nozzle 22 extends. The constriction 30 can be disposed further from the exit port 28 than what is illustrated in in the figures, as further explained below. The constriction 30 is sometimes referred to as a Venturi restriction.

Figure 3:
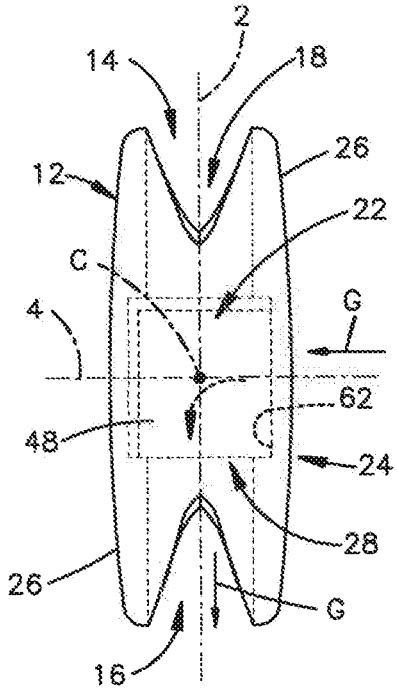
FIG. 3 is a side view of the flow control device illustrated in FIGS. 1 and 2.

Turning to FIGS. 2 and 3, in operation, a fluid G enters the nozzle 22 via the entry port 24 and is directed out of the nozzle exit port 28 toward the second opening 16. When the flow control device 10 is within a fluid, whether the same fluid that is conveyed through the nozzle 22 or a different fluid, discharge of the fluid from the port 28 generates low pressure areas in the passage 18 between the constriction 30 and second opening 16. The low pressure areas draw fluid proximate the opening 14 external to the flow control device 10 into the passage 18 and along bypass channels 56 and 58 to intermix or combine with the discharge flow from the nozzle exit port 28. The fluid from intake side of the device 10 near opening 14 and fluid discharged from the exit port 28 are together ejected from the second opening 16 at greater rate of flow compared to the intake flow rate into the nozzle 22.

As illustrated in FIGS. 2-5, the body 12 has a disc shape with opposed outer ends 32 and 34 and a side 36 that extends from outer end 32 to outer end 34 along a transverse axis 4 that is perpendicular to and intersects the central axis 2. The outer ends 32 and 34 are disposed opposite sides of the central axis 2 and a transverse axis 6 that is perpendicular to and intersects the central axis 2 and the transverse axis 4 at a center C. The central axis 2 may be referred to as a first axis 2 and the transverse axis 4 may be referred to as the second axis 4 and transverse axis 6 may be referred to as the third axis 6. The outer ends 32 and 34 are configured as curved surfaces. However, the outer ends 32 and 34 can be substantially flat surfaces that are substantially parallel to axes 2 and 6. As illustrated, the body 12 defines a thickness T that extends from the outer end 34 to the outer end 32 along direction A that is aligned with axis 4. The thickness T can vary along a direction B that is aligned with the transverse axis 6 when the outer ends are curved. The outer ends may be curved, flat, or have other surfaces features based on the end use application.

As shown in FIG. 2, the side 36 is curved around and with respect to the transverse axis 4. As illustrated, the side 36 defines a circular outer cross-sectional shape that is perpendicular to the transverse axis 4. It should be appreciated that the outer cross-sectional shape of the body 12 can be non-circular. For example, the outer cross-sectional shape can be oval, rectilinear, or assume any particular shaped as needed. The outer ends 32, 34 and sides 36 are defined by the outer surface 26. The side 36 can define a cross-sectional dimension that is perpendicular to central axis 2 or transverse axis 4 that extends from one point along the side 26 to an opposed point along the side 26.

For a down-jet or nozzle used in pool applications, for example, the thickness T may be between 0.25 in and 2.5. in. The cross-sectional dimension may be referred to as a diameter F and may be between 1.0 in. and 5 in. In one example, the diameter is 2.25 in. The flow control device 10 illustrated in FIG. 1-7, however, is not limited to use a down-jet device or devices for pool applications.

Figure 5:
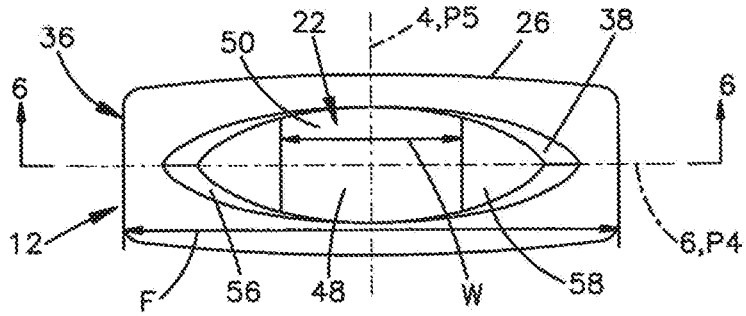
Figure 6:
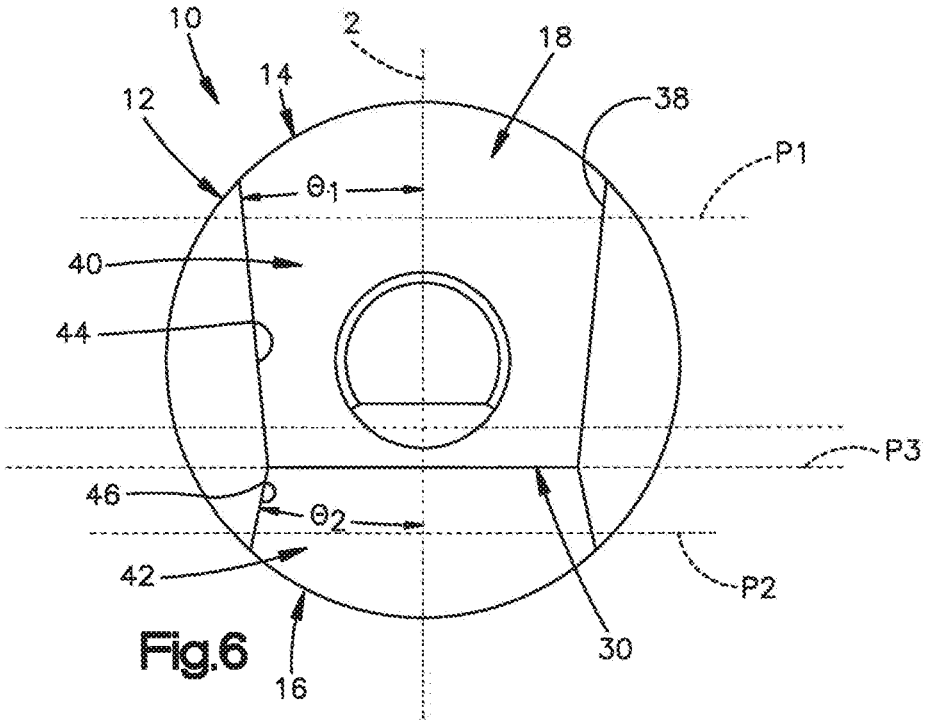
FIGS. 6 through 7B are cross-sectional views take along line 6-6 in FIG. 5.
Figure 7:
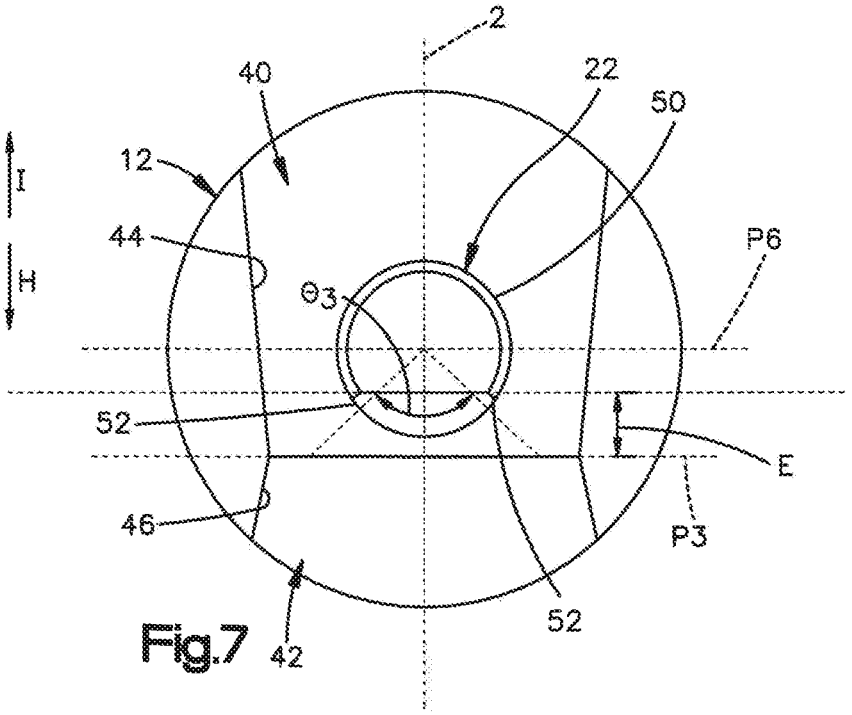

Turning to FIGS. 6 and 7, the body 12 includes an inner surface 38 that at least partially defines the passage 18 and the constriction 30. The inner surface 38 is opposed to the outer surface 26 (see FIG. 5) at the outer ends 32 and 34. The passage 18 also extends from the first opening 14 to the second opening 16 along the central axis 2.

Continuing with FIG. 6, the passage 18 further includes a convergent portion 40, the constriction or throat 30, and a divergent portion 42 opposite the constriction 30 relative to the convergent portion 40. The constriction 30 separates the convergent portion 40 and the divergent portion 42. The constriction 30 extends into the passage 18 toward the central axis 2 along a direction that is perpendicular to the first axis 2. As illustrated, the cross-sectional area of the passage is perpendicular with respect to the central axis 2. The cross-sectional area of passage varies along the central axis 2. For instance, the inner surface 38 defines a first cross-sectional area of the passage 18 along a first plane P1 that is perpendicular to the first axis 2 and that extends through the inner surface 38 proximate the first opening 14. The inner surface 38 further defines a second cross-sectional area of the passage 18 along a second plane P2 that is perpendicular to the first axis 2 and that extends through the inner surface 18 proximate the second opening 16. The inner surface defines a third cross-sectional area of the passage 18 along a third plane P3 that is perpendicular to the first axis 2 and that is aligned with the constriction 30. The third cross-sectional area is less than the first cross-sectional area in the convergent portion 40 and the second cross-sectional area in the divergent portion 42. Accordingly, the inner surface 38 defines a cross-sectional area of the passage 18 that is aligned with the constriction and is less than the cross-sectional area along an entirety of the remaining portions of the inner surface 38 defining the passage 18.

Figure 4:
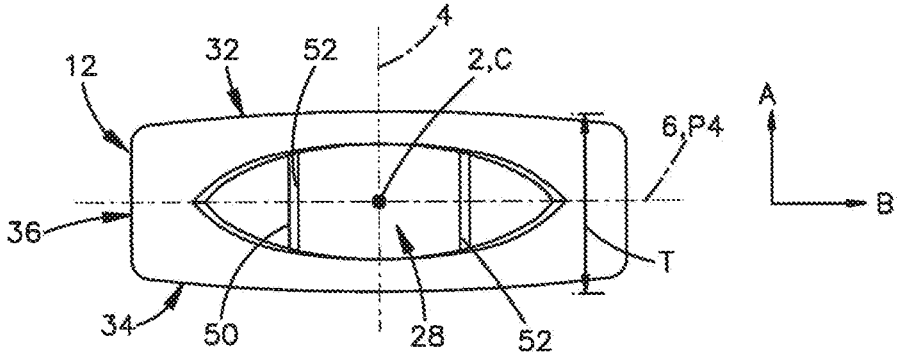
FIGS. 4 and 5 are outlet and inlet end views of the flow control device illustrated in FIGS. 1-3, respectively.

Continuing with FIGS. 4 through 6, as illustrated the passage 18 has an elliptical cross-sectional shape. As illustrated, the inner surface 38 defines the cross-sectional shape of the passage 18 that extends along a plane that is perpendicular to the central axis 2 and intersects the inner surface 38. The elliptical cross-sectional shape can be characterized by a first cross-sectional dimension that is aligned with the transverse axis 6 and is perpendicular to and intersects the central axis 2, and a second cross-sectional dimension that is aligned with transverse axis 4 and is perpendicular to the first cross-sectional dimension. For an elliptical shaped passage, the first cross-sectional dimension does not equal the second cross-sectional dimension. For instance, the first cross-sectional dimension is greater than the second cross-sectional dimension. Accordingly, the first cross-sectional dimension can be referred to a major dimension and the second first cross-sectional dimension can be referred to as the minor dimension. In one example, in a down jet or nozzle used in pool, the first or major cross-sectional dimension can be between about 1.0 in to about 10 in. and the second or minor cross-sectional dimension can be between about 0.5 in to about 9.0 in. The dimensions are not limited as the flow control device 10 is scalable for use in other applications that would require much larger sized devices.

As illustrated in FIGS. 4-7, the convergent portion 40 and the divergent portion 42 of the passage 18 may be tapered with respect to central axis 2. The body 12 extends along a first plane P4 (FIG. 5) that extends through the passage 18 along central axis 2 and is perpendicular to the transverse axis 4. The plane P4 contains the central axis 2 and transverse axis 6 and extends through the side 36 of the body 12. A second plane P5 (FIG. 5) extends along the first axis 2 and intersects and is perpendicular to the first plane P4 and transverse axis 6. The second plane P5 contains the transverse axis 4 and extends through outer ends 32 and 34. The convergent portion 40 of the inner surface 38 defines a line 44 along the inner surface 38 that lies on plane P4 and that is angled with respect to the central axis 2. Thus, the convergent portion 40 of the inner surface 38 defines a first angle θ1 with respect to the central axis 2 of between about 5 degrees to about 15 degrees. The convergent portion is not limited to this range. The divergent portion 42 of the inner surface 38 defines a line 46 along the inner surface 38 that lies on plane P4 and that is angled with respect to the central axis 2. Thus, the divergent portion 42 of the inner surface 38 defines a second angle θ2 with respect to the central axis 2 of between about 5 degrees to about 15 degrees. The divergent portion is not limited to this range. The first and second angles θ1 and θ2 may be equal to each other as illustrated in FIG. 7. Alternatively, the first and second angles θ1 and θ2 may be different as needed. Furthermore, the convergent and divergent zones may be offset with respect to each other. The body 12 can be configured so that the convergent portion extends along first axis 2 and the divergent portion 42 is angularly offset with respect to the convergent portion along a direction that is angularly offset with respect to the first axis. For instance, in one example the divergent portion can extend along a direction that is aligned with the second axis 4 (or axis 6).

Figure 8A:
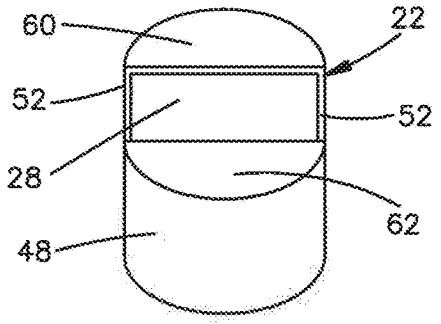
FIGS. 8A-8D are perspective end views of alternative designs for a nozzle in the flow control device illustrated in FIGS. 1-7.

Referring to FIGS. 3-5, the flow control device includes a nozzle 22 disposed in the inlet opening 22 that extends into the passage 18. The nozzle 22 includes a nozzle body 48 that extends at least from the outer surface 26 into the passage 18 along the transverse axis 4. The nozzle 22 is shown substantially flush with the outer surface 26 of the body 12. The nozzle 22, however, can be configured to have a length that extends out of the flow control body 12 along the transverse axis 4. In such an embodiment, the nozzle can be extended to fit with or engage a fluid source or other engagement features of the assembly to which the flow control device 10 is attached. The nozzle body 48 can be an elongate conduit defined at least partially by a nozzle wall 50. The nozzle body 48 has a first end (not numbered) that defines the entry port 24 (FIG. 3) and a second end (not numbered) opposed to the first end and located in the passage 18 adjacent to body inner surface 38. The second end of the nozzle body 48 defines the exit port 28 that is disposed within the passage 18. The wall 50 extends along transverse axis 4 from the first end that is aligned with or proximate the outer surface 26 to the second end located in the passage 18. In one example, the nozzle body 48 extends entirely across the passage 18 so that the second end is adjacent to or defined by the inner surface 38 of the body. The nozzle body 44 defines a nozzle width W that extends along a direction B from one point along the wall 50 to an opposed point along the wall 50. Along a portion of the nozzle body 48 that is located in the passage, the wall 50 extends partially about the transverse axis 4 to define terminal wall edges 52 (FIG. 7) and terminates at wall 60 (FIG. 8A). The wall edges 52 and terminal wall 60 define the exit port 28. As illustrated, the wall edges 52 are angled with respect to each other to define an edge angle θ3 between lines that extends along edges 52. In one embodiment, the edge angle θ3 is between about 100 degrees to about 120 degrees. In one example, the edge angle θ3 is about 111 degrees. The nozzle body width W is less than the cross-sectional dimension of the passage along the transverse axis 6 such that bypass channels 56 and 58 extend along opposed sides of the nozzle body 48. The nozzle 22 includes a block or flat surface 62 at the inlet port defines a wall across the exit port 28. The block 62 causes inlet fluid G to shear and divert stream discharge from a direction aligned with the transverse axis 4 to a direction aligned with the central axis 2 with little loss of efficiency. The cross-sectional area of the bypass channels 56 and 58 on either side of the nozzle wall 52 are similar to the discharge port 28.

Referring to FIGS. 6 and 7, the nozzle 22 is disposed in the passage 18 such that the exit port 28 is proximate to the constriction 30. As illustrated, the constriction 30 is spaced from the exit port 28 in a downstream direction H aligned with axis 2 toward the second or discharge opening 16. Specifically, the exit port 28 extends along a plane P6 that is perpendicular the central axis 2 and the construction 30 is disposed along plane P3. The nozzle 22 is spaced from the constriction 30 a distance E that extends from the plane P6 to plane P3 along the central axis 2. In one example the distance E is greater than zero (0). In alternative embodiments, the constriction 30 is aligned with the exit port 28 of the nozzle such that the distance E is zero (0). In other embodiments, the constriction 30 is spaced from the plane P6 aligned with the exit port 28 of the nozzle 28 in an upstream direction I that is opposite the downstream direction H toward the first opening 14.

Figure 7B:
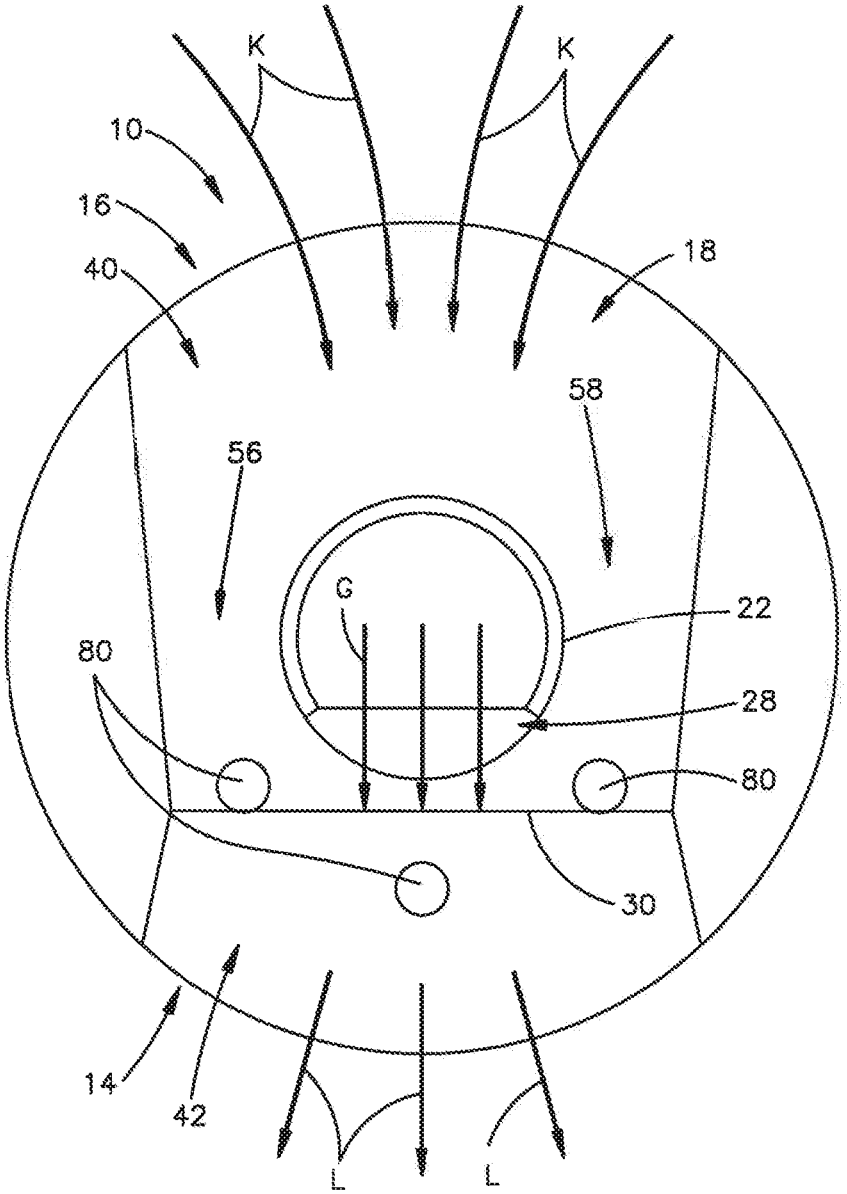

Referring to FIG. 7B, the fluid flow control device 10 is based, in part, on application of Bernoulli's Principal to increase flow rates across the flow control device 10. The flow control device 10 takes advantage of the Bernoulli Principal by creating a low pressure draw of fluid K entrained in the passage 18 along convergent portion 40, which forces fluid into a restriction of passage 18 proximate the constriction 30, which accelerates flow rate at the constriction 30 and toward the second opening 16. The constriction 30, or Venturi restriction, positioned relative to the exit port 28 of the nozzle 22, as noted above, helps create low pressure areas. Specifically, fluid G input into the nozzle 22 and discharged from the exit port 28 creates at least three distinct low pressure areas 80 along the constriction 30 and along outer edges of the passage 18. The lower pressure areas 80 combine to increase the flow rate over nozzle 22 and through the bypass channels 56 and 58, which draws fluid downward from the first opening 14. The drawn fluid combines with the discharge flow from the nozzle 22 in the divergent portion 42 and increases flow volume exiting the outlet opening 16.

Without being bound by any particular theory, it is understood that nozzle 22 and discharge port 28 function like a typical Venturi meter to form low pressure areas below the nozzle 22. For instance, in typical Venturi-type meters, the fluid is accelerated through a converging cone of angle 15-20 degrees and the pressure difference between the upstream side of the cone and the throat is measured and provides an indication for the flow rate. By injecting fluid at a point upstream of constriction 30 in combination with a downstream directed nozzle, the low pressure areas will form in the divergent portion 42 and fluid flow rate will increase. This results in fluid external to the opening 14 to be drawn into the low pressure areas in the divergent portion 42 at a greater flow rate compare to flow rate the fluid entering the convergent portion 40. In other words, by restricting the cross-sectional dimension of the passage 18, fluid passing through the passage 18 experiences lower pressure and higher flow rates. It is believed the by utilizing a shaped passage, the flow control device 10 creates additional acceleration by taking advantage of the behavior of fluids in the passage. For instance, elliptical passage shapes increase fluid flow velocity, reduce static pressure, concentrate dynamic pressure and streamline the total pressure of fluid flowing through the elliptical passage. Accordingly, by combining a constriction 30 with an elliptical cross-sectional shaped passage in one example, increased flow rates at control device discharge and increase suction of the fluid external to the opening 14 can be obtained. It should be appreciated, therefore, that the relationship between the upstream angle of the convergent portion 40 and the downstream angle of divergent portion 42 can be manipulated to maximize efficiency of flow through the flow control device 10.

Figure 8B:
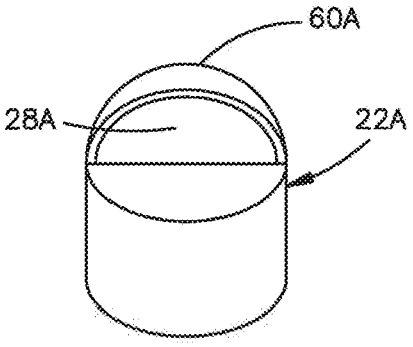
Figure 8C:
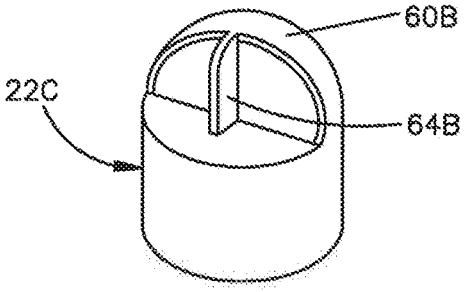
Figure 8D:
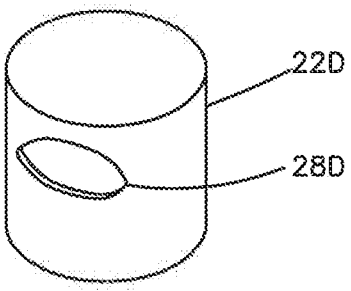
Figure 9A:
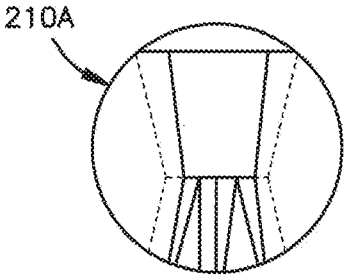
FIGS. 9A-9D are perspectives of a flow control device body in the flow control device according to an alternative embodiment of the present disclosure.
Figure 9B:
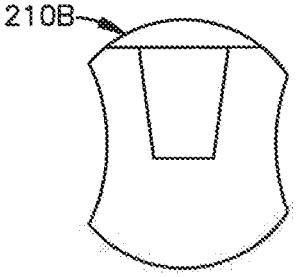
Figure 9C:
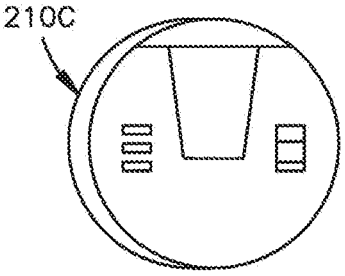
Figure 9D:
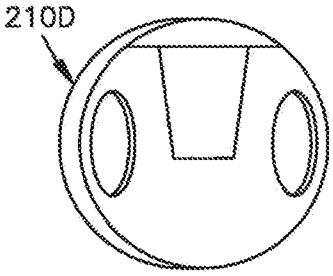

Referring now to FIGS. 8A-8D, which illustrate nozzle designs according embodiments of the present disclosure. FIG. 8A illustrates an example of the nozzle 22 illustrated in FIGS. 1-7 and described above. FIGS. 8C through 8D illustrate alternative nozzle body designs. Similar reference numbers through figures refer to elements common to each embodiment. As can be seen in FIG. 8A, the exit port 28 has a rectilinear shape defined by the terminal wall 60 (terminal wall 60 defines the first end of the nozzle body described above), and wall edges 52. The nozzle body 48 defines a flat surface 62 that extends from the exit port 28 toward an outer perimeter of the wall 50. FIG. 8B illustrates nozzle 22A according to an alternative embodiment with a semispherical end defined by semispherical terminal wall 60B and exit port 28A. FIG. 8C illustrates a nozzle 22C according to another embodiment with a semispherical wall 60B with a bisecting wall 64B that extends between wall 60A and the flat surface 62 to define a pair of exit ports 28B. FIG. 8D illustrates a nozzle 22D according to another embodiment with wall 60 and wall 50 defining elliptical shaped exit port 28D. Other nozzle configurations and shapes can be used in a flow control device.

The flow control device 10 can include a number of flow adjustment features (not shown) disposed along the inner surface 38. For instance, the inner surface could include at least one spline, up to a plurality of separate splines, that extends in a direction from the first opening 14 to the second opening 16. Each spline is configured to direct a flow fluid along a path within the passage. In one example, the splines extend around the first axis 2 as the spline extends along the first axis. For instance, the spline can have a helical orientation.

The flow control device 10 can be formed of polymeric materials, such as thermoplastics or thermosets. In other configurations, the flow control device 10 can be formed of metal alloys. The flow control device 10 can be formed of different parts or components that are manufactured individually and then assembled into the flow control device 10 as described above. For instance, the body 12 can be made of different parts and assembled to define the body 12 and passage 18. Alternatively, the body 12 can be a monolithic body. In still other embodiments, the body 12 and nozzle 22 can be manufactured separately and assembled in to define the flow control device 10. In still other embodiments, the body 12 and nozzle 22 can be a monolithic body. Furthermore, the body 12 can be formed to include any number of surface features for implementation in the particular system, such as flow control devices 210A, 210B, 210C and 210D illustrated in FIGS. 9A-9D.

In one example of the flow control device 10 according to embodiments described herein, such a down jet or nozzle assembly, the flow control device 10 includes a 7 degree angle θ1 defined between a line 44 along the inner surface 38 and the central axis 2. The inner surface 38 has about a 1.5 in. radius of curvature measured with respect to the central axis 2. The cross-sectional surface area aligned with constriction is 0.6 in., and the cross-sectional surface area of the passage 18 proximate the opening is 1.875 in. In this example, the ratio of the convergent portion maximum cross-sectional area to constriction cross-sectional area is about 1:3. In other words, the cross-sectional area of the first opening 14 to the cross-sectional area of the constriction 30 reduced by about 66% percent. In fluids enters the nozzle 22 spaced from the constriction 30 in the upstream direction U a certain distance. The (the outer diameter at plane with the minimum point). The distance between the back wall and the nozzle end should greater than 0.1875 in. The exit port 28 defines a cross-sectional area of about 0.1875 in. based on a length of 0.75 in along axis 6 and width of 0.25 in. along axis 4. The ellipse suction opening 14 is on a 1.5" R and is described, (measured cross section) as 1.9687" W by 0.218" depth. The discharge opening 16 is 1.75"×0.218" on a 1.5" R.

Figure 10A:
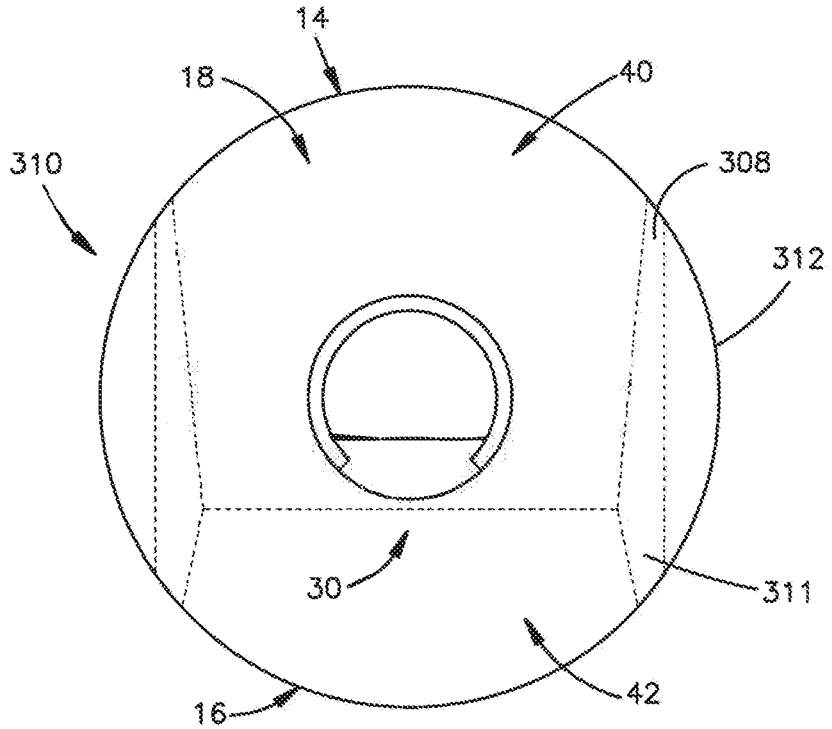
FIGS. 10A-10C are rear sectional, outlet end, an inlet end views of a flow control device according to an alternative embodiment of the present disclosure.
Figure 10B:
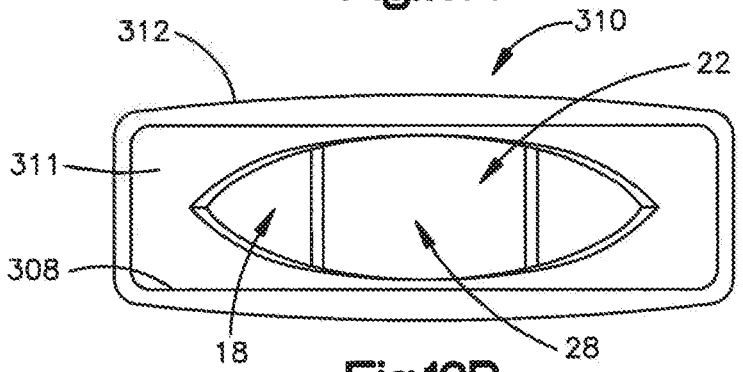
Figure 10C:
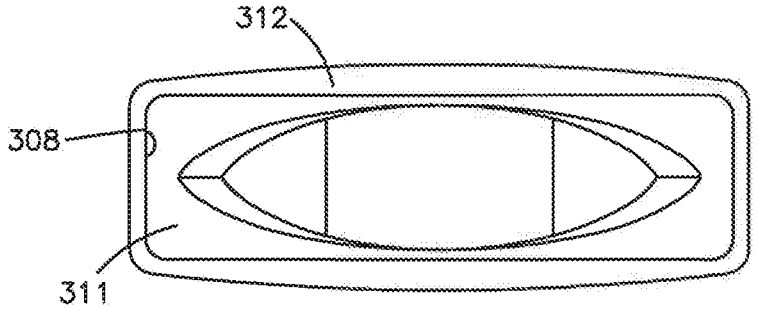

FIGS. 10A-10C illustrate a flow control device 310 according to an alternative embodiment of the present disclosure. The flow control device 310 is similar to the flow control device 10 described above and elements or features common to flow control device 310 and flow control device 10 will use common reference signs. In accordance with the illustrated embodiment, the flow control device 310 includes a body 312, a cavity 308 defined by the body 312, and an insert 311 that is positioned with the cavity 308. The insert 311, however, defines the elliptical passage 118, constriction 30, and an inlet opening 22. Accordingly, the flow control device 310 includes a passage 18 with a convergent portion or zone 40 and a divergent portion or zone, a nozzle 22 defining an exit port 28 that is proximate to the constriction 30.

Figure 11:
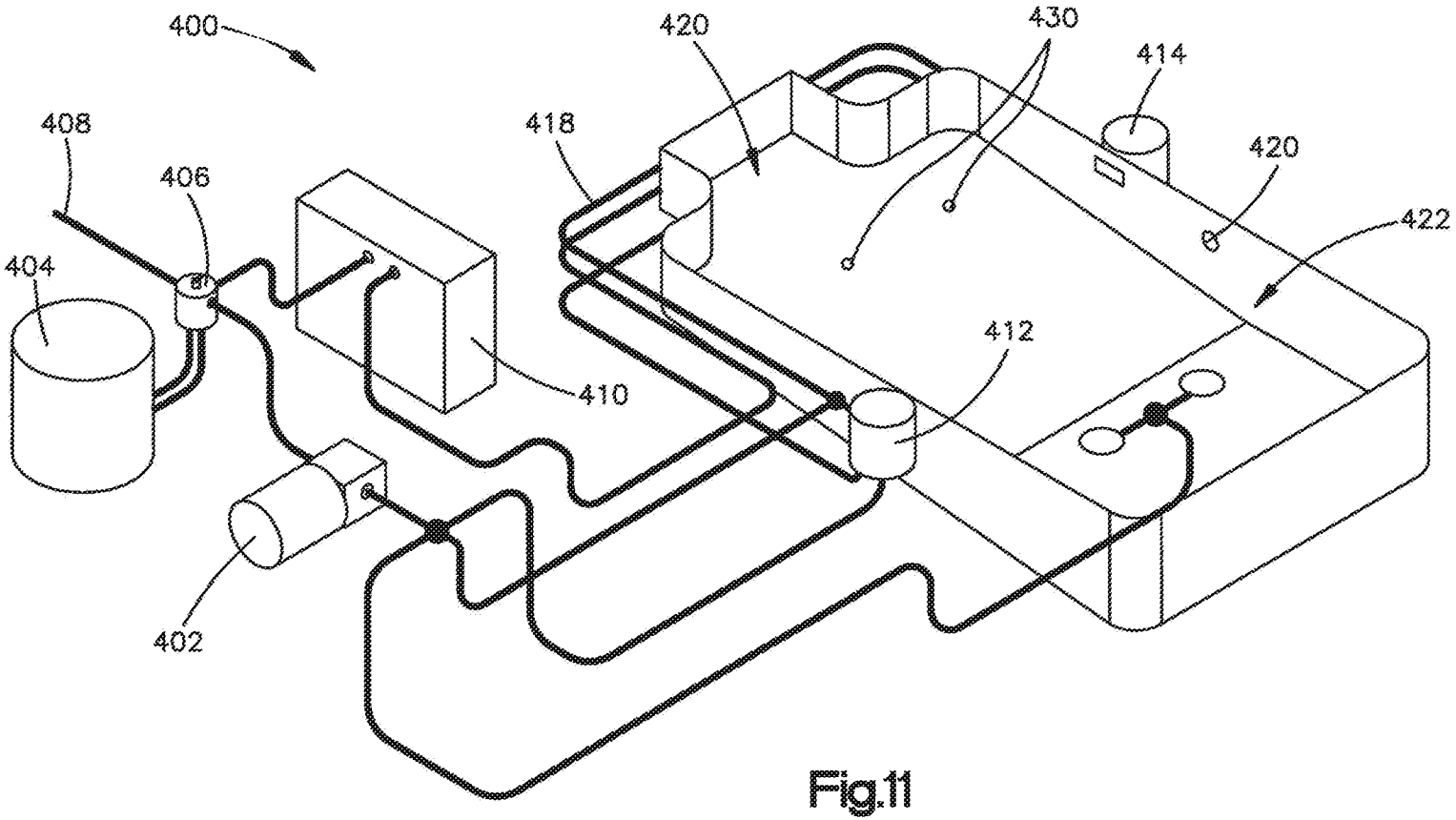
FIG. 11 is a schematic of a pool system according to an embodiment of the present disclosure.
Figure 12:
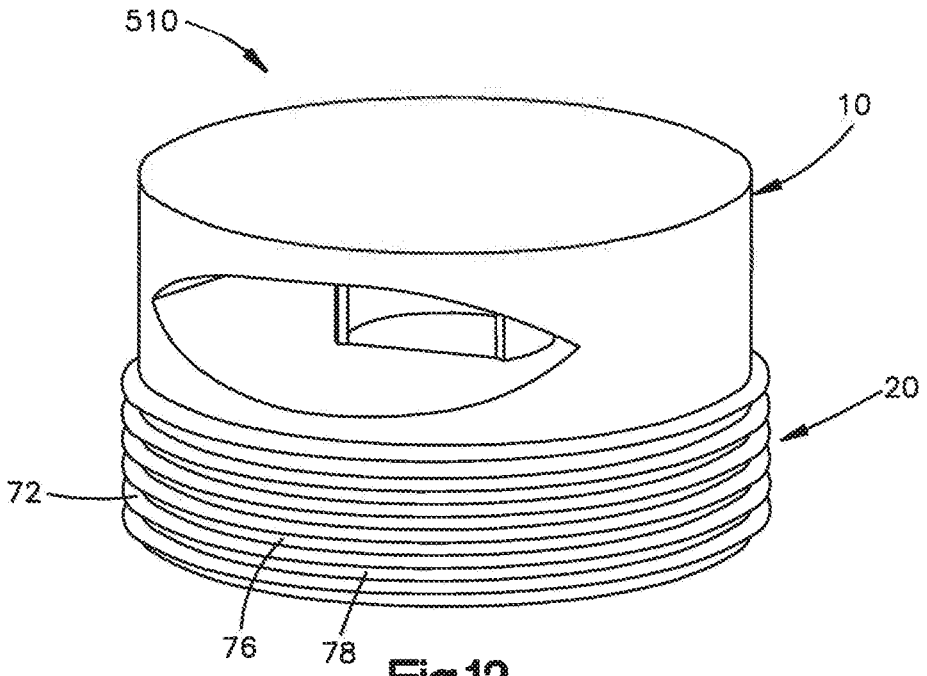
FIG. 12 is a rear perspective views of a flow control device configured as a return jet according to an embodiment of the present disclosure.
Figure 13:
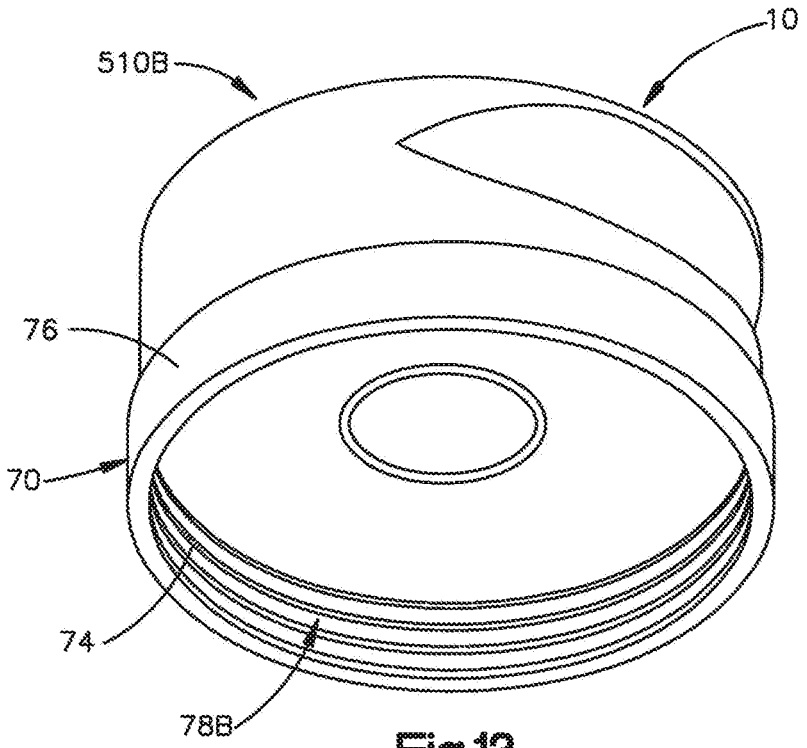
FIG. 13 is a rear perspective view of a flow control device configured as a return jet according to an embodiment of the present disclosure.

FIG. 11 illustrates a pool filtration system 400 according to an embodiment of the present disclosure that includes flow control devices as described herein. Pool system 400 include a pump 402, a filter 404, a valve 406 where conduits from the drain 408 and heater 410 meet. The pool system 400 includes skimmers 412 and 414, a main drain 416, and a plurality of return lines 418 that terminate at returns 420 or return jets. The pump 402 will pull water from the pool 422 through a skimmer 412, 414 or main drain 416. The water is passed through a filter 404, and then filtered water is returned to the pool 422 under pressure through returns 420 and 430 that control flow direction and flow rate. Returns are also referred to as pool jets and are generally mounted on the pool wall below the surface. The return can include pop-up cleaning heads 430 as needed. The water is returned to the pool 422 through the pool jets 420 to create circulation and mixing of the pool water. In accordance with system 400, one or more flow control devices 10, 110, 210, 310, jets 500 or nozzle assemblies may be used to circulate pool water or clean the pool surface.

Figure 14:
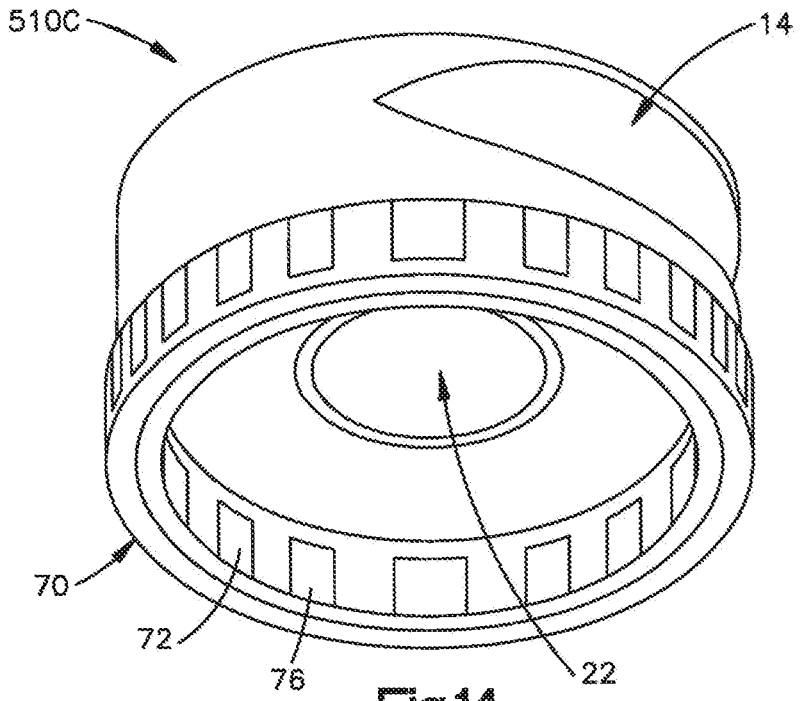
FIG. 14 is a rear perspective view of a flow control device configured as a return jet according to an embodiment of the present disclosure.
Figure 15:
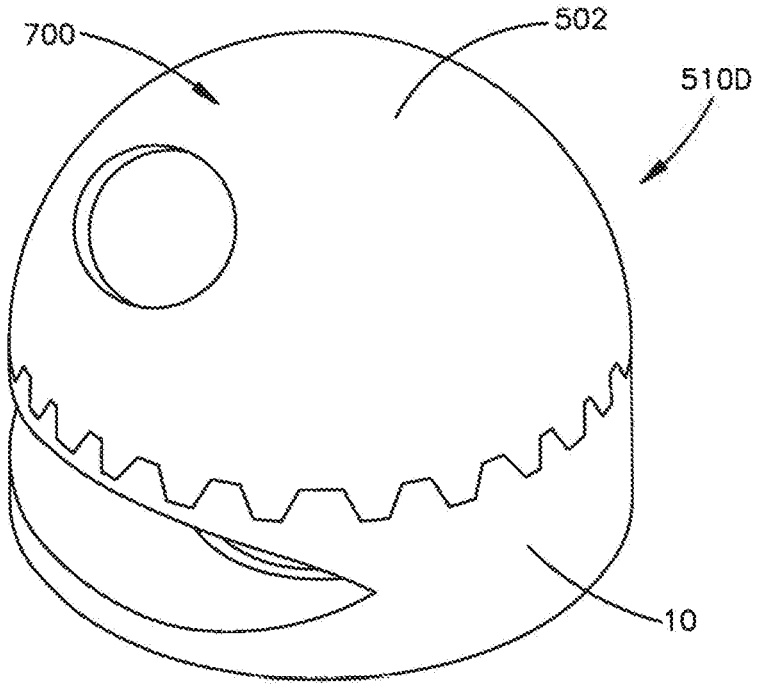
FIG. 15 is a rear perspective view of a flow control device configured as a return jet according to another embodiment of the present disclosure.

Referring to FIGS. 11-15, a return jet 510 can include the flow control device 10 can include a retaining member 70 configured to attach the nozzle 22 to a fluid source. The retaining member 70 includes a retaining member body 72 having an inner surface 74, an outer surface 76 opposed to the inner surface 74, and a securement structure 78 that attaches the flow control device 10 to be coupled to or aligned with the fluid source. In one embodiment shown in FIG. 11, return jet 510 includes a securement structure 78 that is at least one projection disposed along the outer surface of the retaining member body 72, such as a thread. In another embodiment shown in FIG. 12, a return jet 510B can include the securement structure 78B is a thread disposed along the inner surface 74 of the retaining member body 72. In another embodiment as shown in FIG. 14, a return jet 510C includes retaining ring 70 with a securement structure 78C that is at least one projection (or a plurality of projections) disposed along the inner surface 74 of the retaining member body 72. The retaining member 70 is suitable for use in swimming pools and similar environments. In another embodiment shown in FIG. 15, the return jet 510D includes flow control device 10 and a cap 70D. The device 510D includes fourth opening or port 502 that is open to a channel in the cap 70D. The cap 70D can be positioned to direct the channel as needed so that directional control of a discharge is possible.

In another embodiment of the present disclosure, the flow control device 10 can create a 10-12 Hz flutter motion of the water discharged from the device. It is believed that this is a response frequency to induce motion in a piezo strip. Accordingly, the flow control device 10 could be used with a piezo strip to power certain pool systems including sensors and lighting.

Referring to FIGS. 11-15, the return jet 510A, 510B, 510C, and 510D flow control device 10 illustrated in FIGS. 12 through 15 can be also be considered a down-jet or jet return 510 that can be coupled to a pool system return as illustrated in FIG. 11. As described above, the jet return or down jet 510 that includes the flow control device 10 can be mounted to a pool wall. The pool system 400 pumps water through the nozzle 22 to generate a low pressure area within passage 18, which draws additional fluid from the standing water source into circulation with the pumped water to thereby increase total circulation, e.g. by approximately 30%-50% over inlet flow volume. The shape of the passage 18 causes the boundary flow rates of the fluid along both the inlet opening 14 and discharge opening 16 to increase towards the constriction 30. Primary and secondary low pressure areas form in the divergent portion 42 (not shown) to cause static water to flow towards the low pressure zones. The apparent effect is suction that can be felt and seen at the inlet opening 14 and an increased flow rate of 4-9 GPM, dependent upon the scale of the device, over the inlet fluid flow rate at the return. The flow control device 10 can be optimized for flow rate balance, maximized draw, and specific discharge point where fluid is pumped through the discharge port out of the flow control device 10. In one example of using the flow control device in a return jet, it is believed that 1) suction of fluid above the flow control device is at a higher flow rate, and 2) discharge of fluid ejected from second opening 16 is at a greater flow volume, compared to typical down jet ball nozzles alone.

In accordance with the alternate embodiment, the flow control device may include a forward skimmer nozzle with separate fluid by-pass channels. This feature allows the device to have distinct, multiple directions of flow from the same source without affecting manipulation of low pressure to produce the suction effect.

Aspects of the flow control device that are advantageous include a passage that has a defined convergent portion 40, divergent portion 42, and a constriction 30. The convergent portion 42 can be off-set by 90 degrees with respect to the divergent portion 42. The flow control device 10 is configured such that a drawn fluid source is axially aligned with constriction 30 in the passage. Furthermore, the flow control device is scalable for a wide range of applications. With modifications, the flow control device can have a larger size than what is illustrated based on a changing flow rates of the system in which it is installed. For instance, the flow control device can change its size with respect to the changing flow of a given pool system to allow the most efficient design at any flow rate within a pool system. This may be important because the pool industry is trending to variable flow pumps which allow the end user to change water flow based on changing needs within the same pool system. Further, movement of the flow control device within the pool is not limited to a 360 degree of motion parallel to a pool wall, but is also designed to be capable of pointing in a direction perpendicular to the pool wall. The flow control device has a retaining member or other attachment features that allow for its implementation in number of different products, such as nozzle assembly in pop-up cleaning heads, as illustrated in FIGS. 16A-18C.

An embodiment of the present disclosure contemplates water-to-water applications. But the flow control device is not limited to water-water application. For instance, the first fluid can be air and the second fluid can be water. Further, fluids with different viscosities and Newtonian and non-Newtonian fluids could be used as well. Newtonian fluids are fluids for which the shearing stress is linearly related to the rate of shearing strain. Newtonian materials are referred to as true liquids since their viscosity or consistency is not affected by shear, such as agitation or pumping at a constant temperature. Fortunately, most common fluids, both liquids and gases, are Newtonian. Water and oils are examples of Newtonian liquids. Shear-thinning or pseudoplastic liquids are those whose viscosity decreases with increasing shear rate. Their structure is time-independent. Thixotropic liquids have a time-dependent structure. The viscosity of a thixotropic liquid decreases with increasing time at a constant shear rate. Ketchup and mayonnaise are examples of thixotropic materials. They appear thick or viscous but are possible to pump quite easily. Shear Thickening Fluids or Dilatant Fluids increase their viscosity with agitation. Some of these liquids can become almost solid within a pump or pipe line. With agitation, cream becomes butter and Candy compounds, clay slurries and similar heavily filled liquids do the same thing. Bingham Plastic Fluids have a yield value which must be exceeded before it will start to flow like a fluid. From that point, the viscosity will decrease with increase of agitation. Toothpaste, mayonnaise and tomato catsup are examples of such products.

FIGS. 16A through 18C illustrate various embodiments of a nozzle assembly used in a pool system that incorporate the flow control device similar to flow control device 10 described above. The flow control devices 10, 110, 210, 310 described above can implemented as the discharge nozzle in the nozzle assemblies described below and illustrated in FIGS. 16A-18C. Accordingly, elements and features of flow control device 10 described above that are common to flow control device used in nozzle assemblies described below will use common reference signs.

Figure 16B:
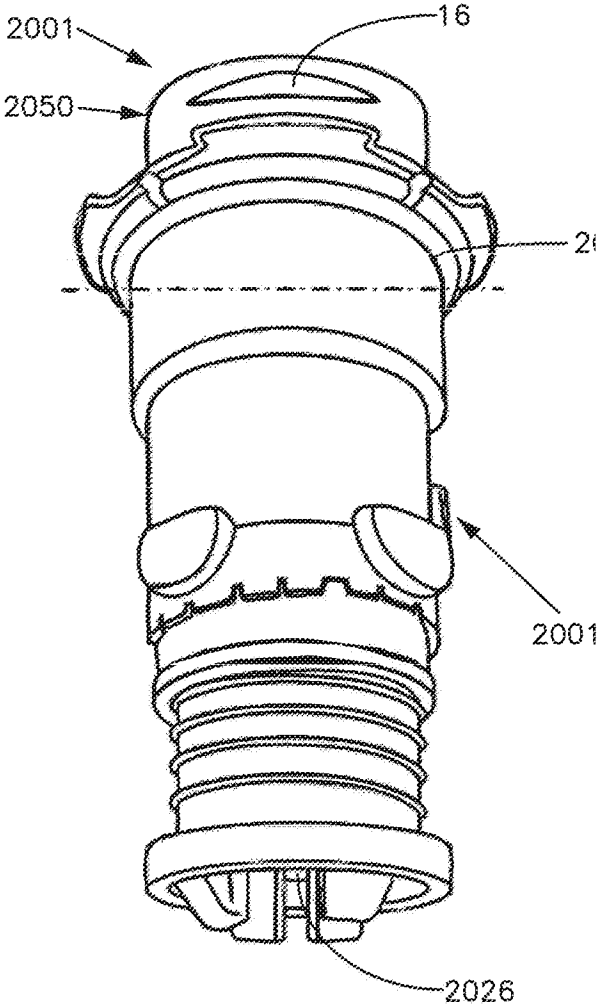
FIG. 16A and FIG. 16B are perspective views of a nozzle assembly in a closed configuration and an open configuration, respectively, according to an embodiment of the present disclosure.
Figure 16A:
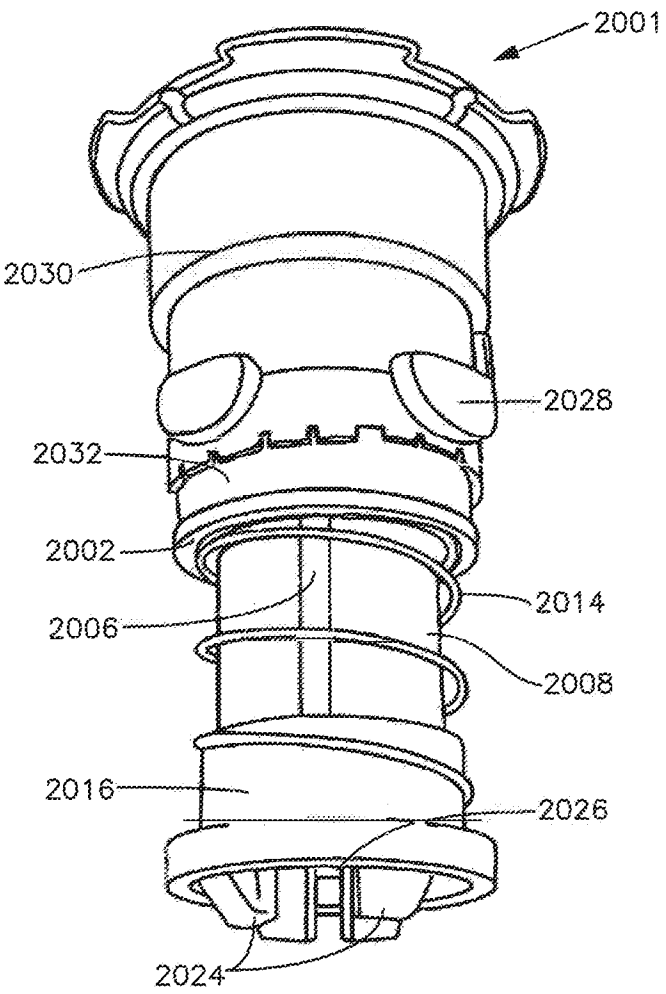

Referring to FIGS. 16A-16I illustrate an embodiment of nozzle assembly 2001 for use in swimming pools and the like. The nozzle assembly 2001 can include a flow control device 2050 that is similar to the flow control device 10 described above and illustrated in FIGS. 1-7. The nozzle assembly 2001 is configured to transition the flow control device 2050 between an open or extended configuration illustrated in FIGS. 16B and 16I and a closed or retracted configuration as illustrated in FIG. 16A.

Referring to FIG. 16A, an embodiment of an upper washer 2002, a spring element 2014, and a lower washer 2016 are illustrated assembled over a stem 2008. As illustrated, the lower washer 2016 may be retained through a plurality of flexible prongs 2024 at the second end 2026 of the stem 2008. In other particular embodiments of a stem 2008, other methods of retaining the lower washer 2016 may be used including, by non-limiting example, a clip-on cap, a screw-on cap, or a lower washer 2016 that clips or screws onto the second end 2026 of the stem 2008.

FIG. 16A also illustrates that in particular embodiments of a nozzle assembly 2001, the upper washer 2002 may be biased by the spring element 2014 against a retainer or housing 2028. In particular embodiments, the retainer 2028 may include two portions, a first portion 2030 comprising an upper cam half and a second portion 2032 comprising a lower cam half.

Figure 16C:
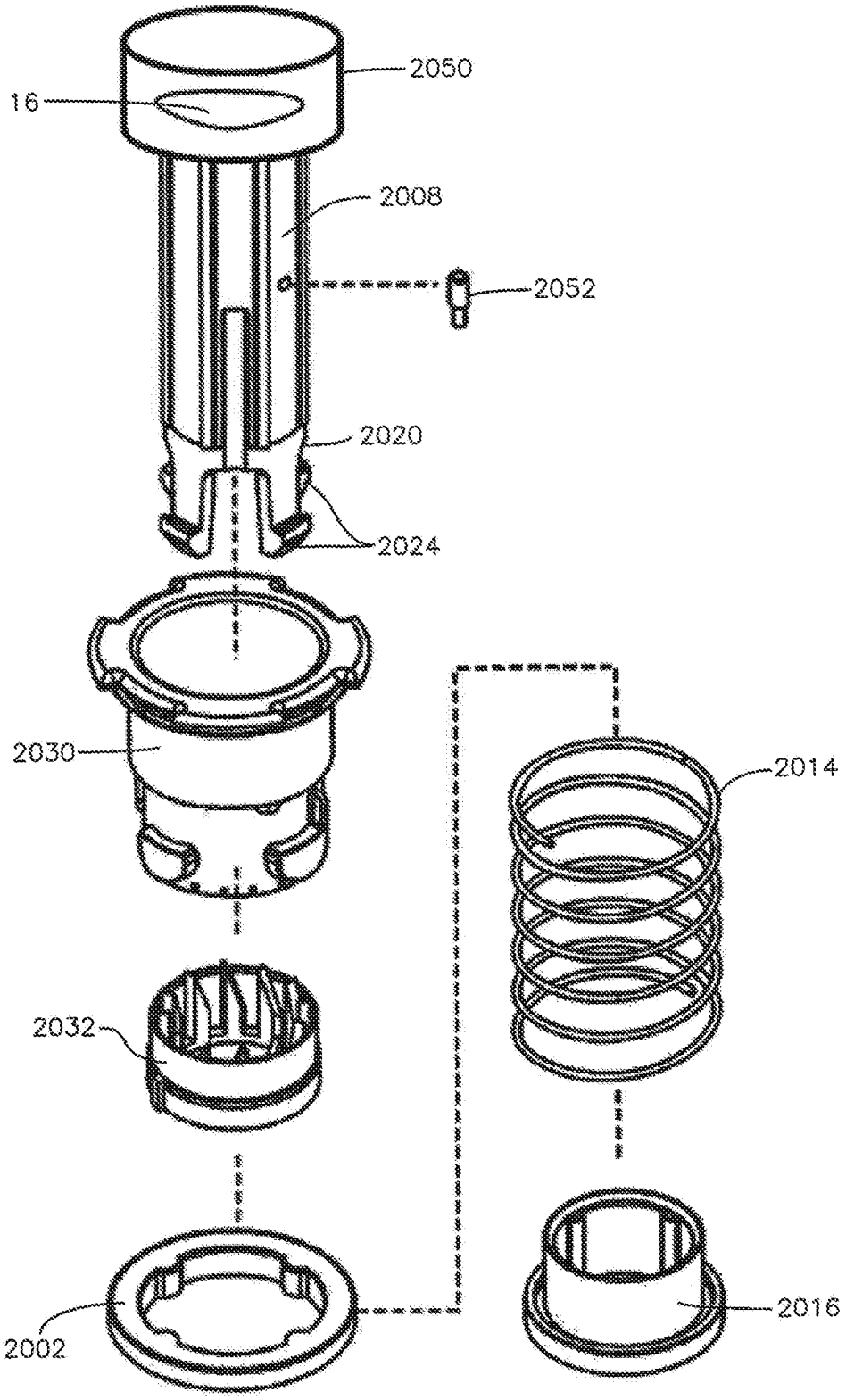
FIG. 16C is a top perspective exploded view of the cleaning head illustrated in FIGS. 16A and 16B.
Figure 16D:
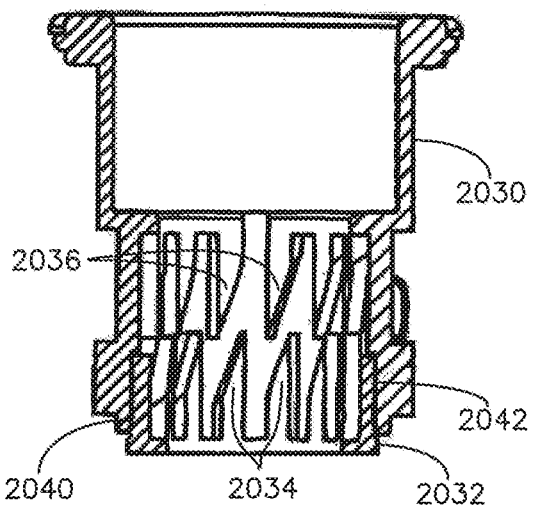
FIG. 16D is a section view of a cam component of the nozzle assembly illustrated in FIGS. 16A-16C.

Referring to FIG. 16D, a cross section view of an embodiment of an upper cam half 2030 and a lower cam half 2032 slidably coupled is illustrated. As shown, the upper cam half 2030 may have a plurality of upper cam teeth 2036. Below the upper cam teeth 2036 may be a bottom edge 2042 of the upper cam half 2030 configured to slidably couple over an upper edge 2040 of the lower cam half 2032. As illustrated in FIG. 16D, although the lower cam half 2032 is slidably coupled into the upper cam half 2030, not all of the lower cam half 2032 is necessarily within the upper cam half 2030; just the portion corresponding to the upper edge 2040.

The cam teeth 2034 of the lower cam half 2032 and the upper cam teeth 2036 are oriented in an alternating fashion to allow the stem 2008 to move rotationally by use of a cam pin 2052 as the nozzle assembly 2001 is alternately activated and deactivated.

Referring to FIGS. 16A and 16D, since the lower cam half 2032 in that embodiment is configured to slidably couple into the upper cam half 2030 in the direction of the bias applied to the upper washer 2002 by the spring element 2014, the bias of the spring element 2014 discourages separation of the upper and lower cam halves 2030, 2032. In addition, since the lower cam half 2032 couples into the upper cam half 2030 in the direction of the pressure gradient through the nozzle assembly 2001, the force generated by liquid pressure on the nozzle assembly 2001 serves to further unite the upper and lower cam halves 2030, 2032. Accordingly, particular embodiments of the two part cam assembly may be assembled without the need for an adhesive because the spring element 2014 and water pressure force the two parts together rather than apart.

Figure 16E:
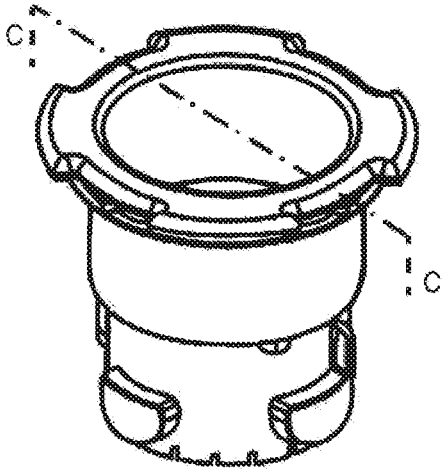
FIG. 16E is a top perspective view of a upper cam portion of the cam component illustrated in FIG. 16D.
Figure 16F:
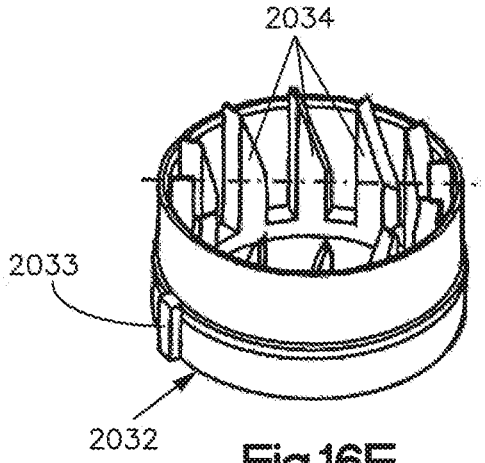
FIG. 16F is a top perspective view of a lower cam portion of the cam component illustrated in FIG. 16D.

FIG. 16B illustrates an embodiment of a nozzle assembly 2001 in an extended position, where the flow control device 2050 in a first end 2051 of the stem 2008 is visible and is in fluid connection with the second end 2026. FIG. 16I illustrates a cross section view of the embodiment shown in FIG. 16B along the sectional line D. The nozzle assembly 2001 moves to the extended position when water pressure from a pump sufficient to compress the spring element 2014 is supplied to raise the flow control device 2050 in the first end 2051 of the stem 2008 above the level of the upper cam half 2030. In the extended position, water from the pump is free to flow out of the flow control device 2050. To aid in restricting flow around the stem 2008 while the nozzle assembly 2001 is extended, the spring element 2014 may compress the upper washer 2002 against the lower cam half 2032, and water pressure may compress the second mating element 2022 of the lower washer 2016 against the first mating element 2012 of the upper washer 2002 while the lower washer 2016 engages with the washer races and second end 2026 of the stem 2008. In particular embodiments, the lower washer 2016 may not engage the washer races of the stem 2008. Water flow around the stem 2008 may be reduced, forcing a majority of the water from the pump to flow through the stem 2008 out the flow control device 2050. When it is no longer necessary for the nozzle assembly 2001 to be used, the pump pressure may be removed from the assembly, and the bias in the spring element 2014 may retract the flow control device 2050 back down into the upper cam half 2030, and the lower washer 2016 may disengage partially from the washer races and the second end 2026 of the stem 2008 and rest against the flexible prongs 2024 attached to the second end 2026 of the stem 2008.

FIG. 16C illustrates how the various parts of an embodiment of a nozzle assembly 2001 having flexible prongs 2024 on a second end 2026 may be assembled. A stem 2008 containing a flow control device 2050 may have a pin 2052 coupled with a hole along its side to operatively engage with the cam teeth. Next, the upper cam half 2030 may be coupled to the stem 2008 over its second end 2026. The lower cam half 2032, upper washer 2002, and spring element 2014 may all each subsequently in turn be coupled to the stem 2008 and each other over the stem's second end 2026. The lower washer 2016 may then be coupled to the stem 2008 and retained by the flexible prongs 2024 at the stem's second end 2026. Since the lower washer 2016 is retained by the flexible prongs 2024, it serves to bias the spring element 2014 against the upper washer 2002. Once the nozzle assembly 2001 has thus been assembled by coupling each component over the second end 2026 of the stem 2008, the assembly 2001 can be inserted into a housing mounted in the side, stair, or floor of a body of liquid, such as a swimming pool, and connected to a pumping system.

Figure 16G:
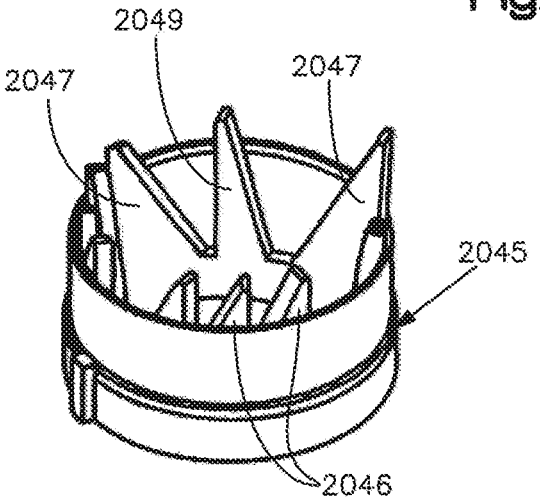
FIGS. 16G and 16H are top perspective view of lower cam portion of the nozzle assembly illustrating cam teeth of varying dimension.

Referring to FIG. 16G, as illustrated, in other particular embodiments, the cam teeth may all be of the same dimensions, may all differ in dimensions, or the spacing of the teeth around the circumference of the lower cam half may be irregular depending on the desired application of a nozzle assembly 2001. In the implementation of a lower cam half 2045 illustrated by FIG. 16G, two of the first cam teeth 2046 are missing while the two second cam teeth 2047 have a third cam tooth 2049 of a smaller dimension between them.

Figure 16H:
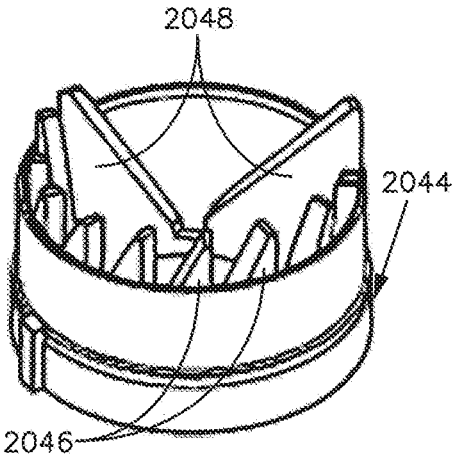
Figure 16I:
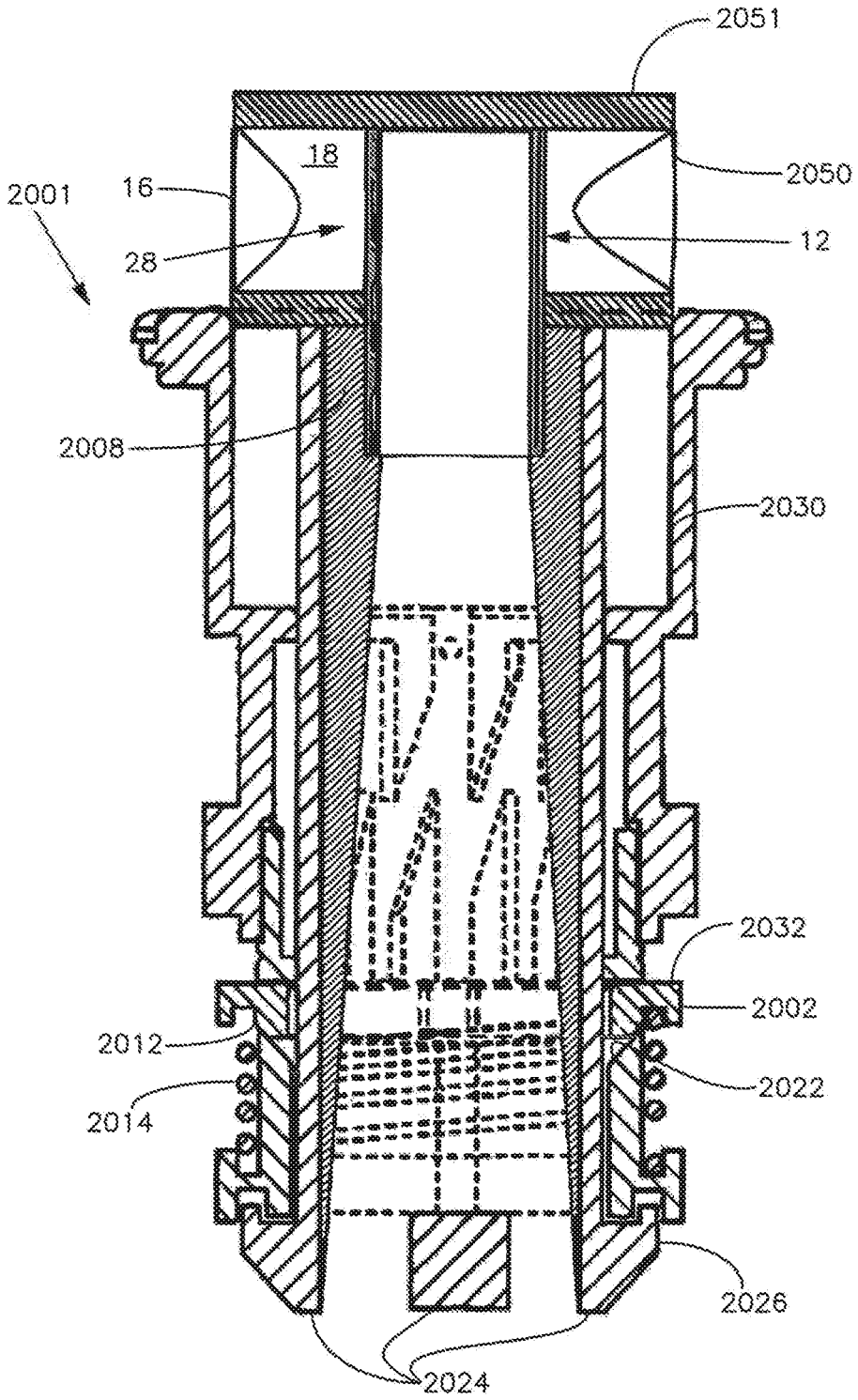
FIG. 16I is a sectional view the nozzle assembly take along line 16-16 in FIG. 16B illustrated in FIGS. 16A-16C.

Referring to FIG. 16H, a particular embodiment of a lower cam half 2044 is illustrated. As shown, the lower cam half 2044 includes a set of first cam teeth 2046 with substantially the same dimensions and a set of second cam teeth 2048 with different dimensions. The different sizes of the cam teeth may permit the nozzle assembly 2001 to rotate in steps of varying length while in use. This feature of the nozzle assembly 2001 allows the assembly to avoid or minimize time spent spraying obstacles like stairs or walls when the nozzle assembly 2001 is installed close to an edge in a swimming pool.

FIGS. 16F and 16E show particular embodiments of the lower and upper cam halves 2032, 2030, respectively. As illustrated, the lower cam half 2032 may include a plurality of cam teeth 2034.

Figure 17A:
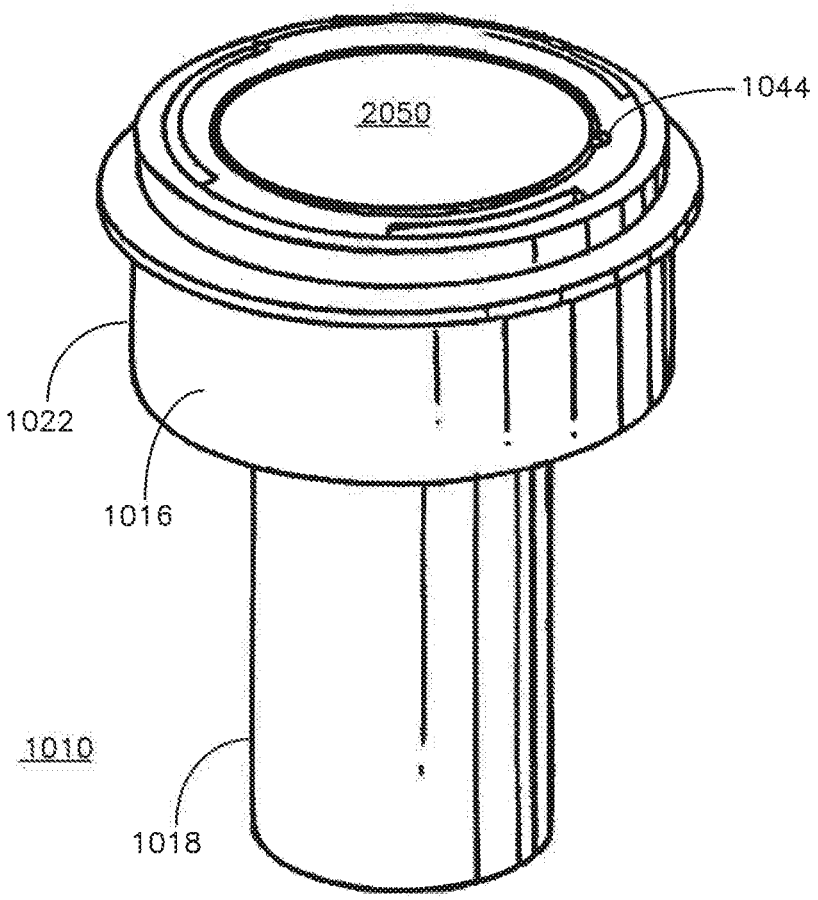
FIG. 17A is a top perspective view of a nozzle assembly according to an embodiment of the present disclosure.
Figure 17B:
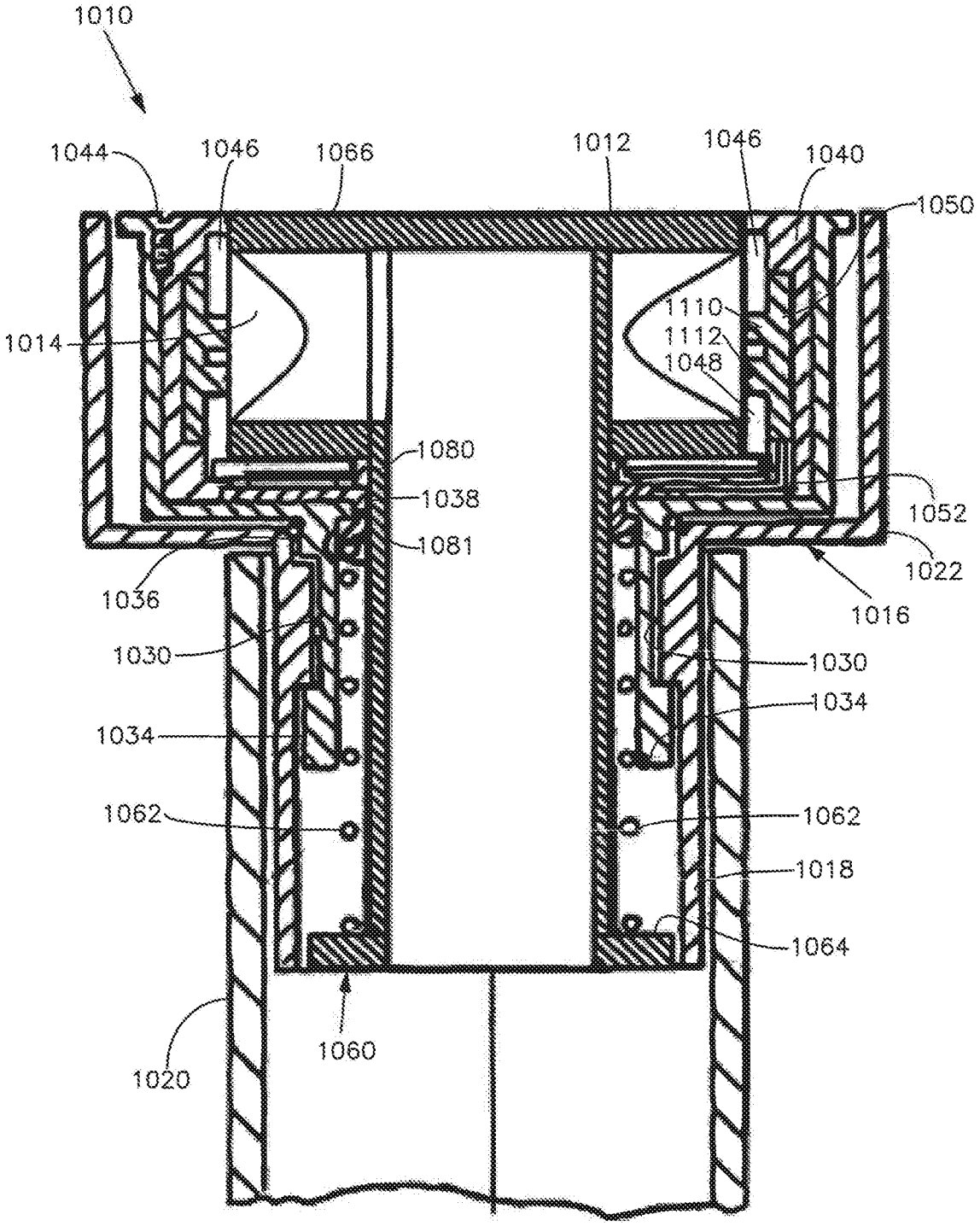
FIG. 17B and FIG. 17C are perspective views of the nozzle assembly illustrated in FIG. 17A in a closed configuration and an open configuration, respectively.

Referring to FIGS. 17A-17D, an embodiment of a recessed incrementally rotating nozzle assembly 1010 is illustrated for use in swimming pools and the like. The nozzle assembly 1010 can include a flow control device 1012 that is similar to the flow control device 10 described above and illustrated in FIGS. 1-7. The nozzle assembly 1010 is configured to transition the flow control device 1012 between an open configuration illustrated in FIG. 17C and a closed or retracted configuration as illustrated in FIG. 17B. In the retracted configuration or position, the upper surface of the nozzle assembly is substantially flush with the adjacent swimming pool surface. The extended position of flow control device 1012 includes a discharge opening 16 through which a stream of water is ejected. Body 1016 includes a hollow cylinder 1018 for attachment to the interior of a conduit 1020 (see FIG. 17B) periodically supplying water under pressure to the nozzle assembly.

A housing can include a diametrically enlarged section 1022 is supported by and extends from cylinder 1018. Referring to the embodiment illustrated in FIG. 17B, cylinder 1018 includes a plurality of lugs 1030 disposed on the interior surface thereof. A retainer 1032, for retaining the operative elements of the nozzle assembly within body 1016, includes a plurality of lugs 1034 extending radially outwardly for locking engagement with lugs 1030 upon passing the lugs 1034 of the retainer 1032 axially past the lugs 1030 of cylinder 1018 and rotating the retainer 1032 to bring about locking engagement. In particular embodiments, an O-ring 1036 or the like may be disposed between the retainer and the cylinder to prevent water flow therebetween.

A cam ring 1040 is rotatably lodged within radially expanded section 1042 of retainer 1032. Rotation of the cam ring 1040 relative to section 1042 is prevented by a screw 1044, or the like, threadedly inserted between cam ring 1040 and section 1042. A plurality of downwardly pointing saw tooth members 1046, or other pin guides 1046, are disposed along the upper part of cam ring 1040. A similar plurality of upwardly pointing saw tooth members 1048, or other pin guides 1048, are disposed along cam ring 1040. A ring-like cam reverser 1050 is slidably lodged adjacent cam ring 1040 and is circumferentially slidably captured between saw tooth members 1046, 1048. An arm 1052 extends downwardly and radially inwardly from the cam reverser 1050. Further details relating to the structure and operation of implementations of the saw tooth members 1046, 1048, the cam reverser 1050, and the arm 1052 will be described later in greater detail.

A sleeve 1060 is vertically translatable upwardly within housing, that includes a cylinder 1018, in response to water pressure present within conduit 1020. Such vertical translation is resisted by a coil spring 1062 bearing against an annular lip 1064 of the sleeve 1060, a lip 1081 associated with a pattern cam 1080, and the retainer 1032. Flow control device 1110 is supported upon sleeve 1060 and defines the discharge opening 16 (which is same as the opening 16 described above) through which a stream of water L (FIG. 7B) is ejected upon upward translation of the sleeve 1060. In the absence of water pressure within conduit 1020, coil spring 1062 will draw sleeve 1060 and nozzle assembly 1012 downwardly to the retracted position illustrated in FIG. 17B. A pair of diametrically opposed pins 1070,1072 (not shown) extend radially outwardly from flow control device 1012 for sliding engagement with sets of saw tooth members 1046, 1048, which engagement causes flow control device 1012 to rotate incrementally each time it is extended and retracted under the influence of water pressure, as will be described in further detail below.

A pattern cam 1080 is positionally fixed upon radially extending shoulder 1038 formed as part of retainer 1032. It includes lip 1081 extending around the interior edge of shoulder 1038. The pattern cam 1080 is configured to determine the angular extent of reciprocating rotation of flow control device 1012. Particular embodiments of a pattern cam 1080 may define an angle of reciprocating rotation of 180 degrees or ninety degrees; however, for embodiments utilized in specific locations within a swimming pool, a greater or lesser angle of reciprocating rotation may be selected to ensure washing/scrubbing of the swimming pool surface of interest.

Figure 17C:
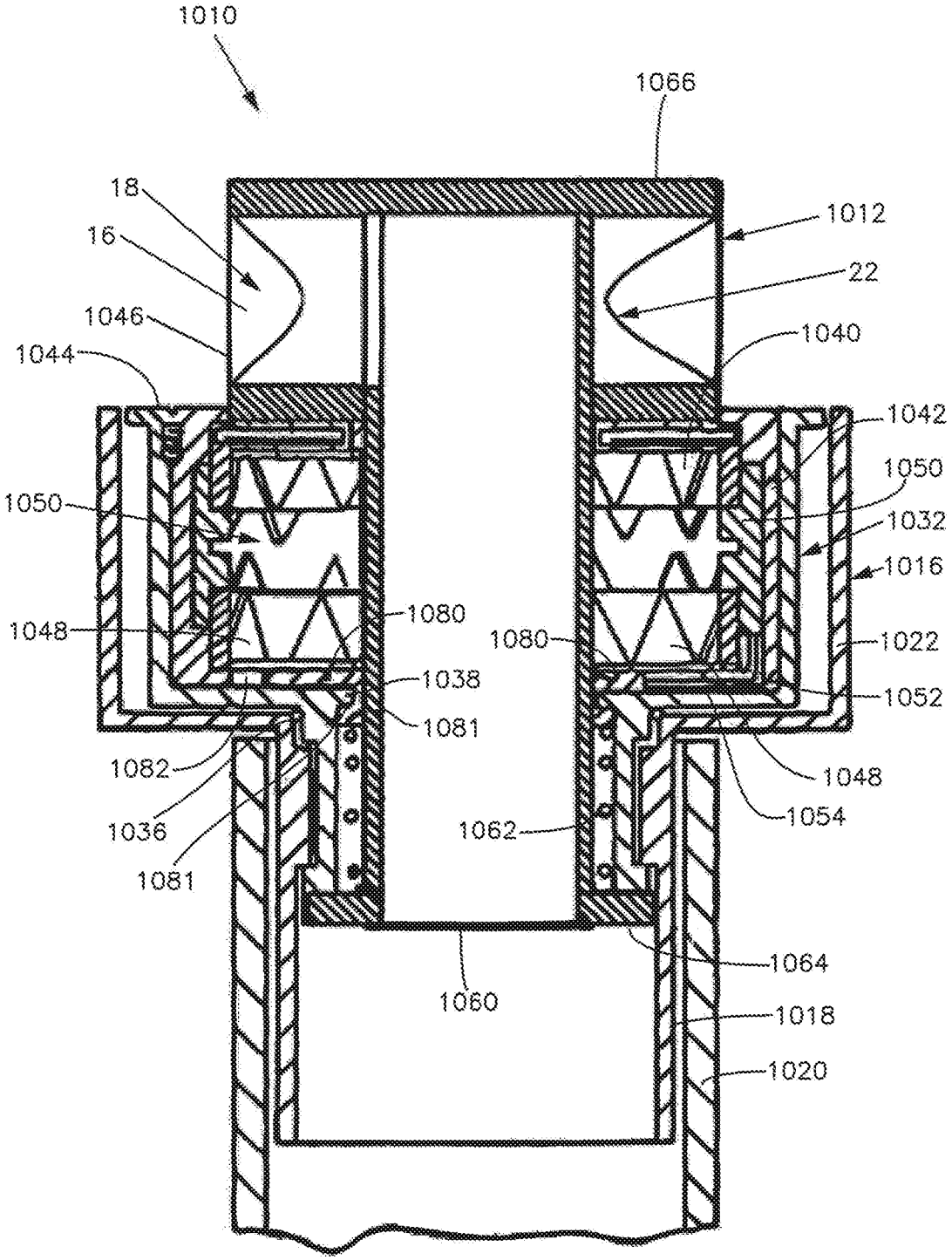

Referring to FIG. 17C, an embodiment of a pattern cam 1080 is illustrated. Sleeve 1060 includes a keyway to serve in the manner of an index. Pattern cam 1080 includes an annular arc extending from semi-circular disc 1082, the combination of which surrounds sleeve 1060. Annular arc includes a key mating with keyway of sleeve 1060; thereby, the pattern cam 1080 is indexed with the sleeve 1060 and will rotate commensurate with flow control device 1012, also fixedly attached to the sleeve. Arm 1052 is terminated by a flat roundel 1054 disposed in the horizontal plane of disc 1082. As sleeve 1060 rotates in response to pins 1070, 1072 sequentially contacting saw tooth members 1046, 1048, pattern cam 1080 will rotate commensurately. When one of edges of disc 1082, such as edge, contacts roundel 1054 as the disc rotates in, for instance, a counterclockwise direction as viewed in FIG. 3, the force of edge 1089 acting upon roundel 1054 will cause the roundel 1054, arm 1052, and cam reverser 1050 to be repositioned incrementally counter clockwise as a function of the spacing between adjacent saw tooth members 1046,1048 (see FIG. 2). The resulting repositioning of the cam reverser results in a change in direction of rotation of sleeve 1060 along with attached flow control device 1012. On the completion of incremental steps of rotation in the counter clockwise direction, edge of disc 1082 will contact the other side of roundel 1054 and cause it to be translated incrementally clockwise. Such translation of the roundel 1054 is translated via arm 1052 to cam reverser 1050 and the rotation of sleeve 1060 and flow control device 1012 will change direction.

FIG. 17C illustrates an embodiment of a nozzle assembly configures so that the flow control device 1012 in the extended position. In this condition, water pressure exists within conduit 1020 and causes sleeve 1060 to be raised against the bias supplied by coil spring 1062. As the sleeve 1060 rises, it causes flow control device 1012 to rise, as illustrated. As the flow control device 1012 rises, pins 1070, 1072 rise in the spaces formed by the edges of intermediate saw tooth members 1046. Because the pins 1070,1072 bear against the edges of saw tooth members 1046, which are slanted opposed sides, the pins 1070,1072 are angularly translated about the vertical axis of nozzle assembly 1010, rotating flow control device 1012 incrementally a corresponding angular distance. When water pressure within conduit 1020 is terminated, the bias supplied by coil spring 1062 will cause sleeve 1060 to retract and the flow control device 1012 will be lowered within section 1022, as shown in FIGS. 17A and 17B. As flow control device 1012 is lowered, pins 1070, 1072 contact the edges of saw tooth members 1048 and angularly translate once again, rotating the flow control device 1012 incrementally a corresponding angular distance.

Figure 17D:
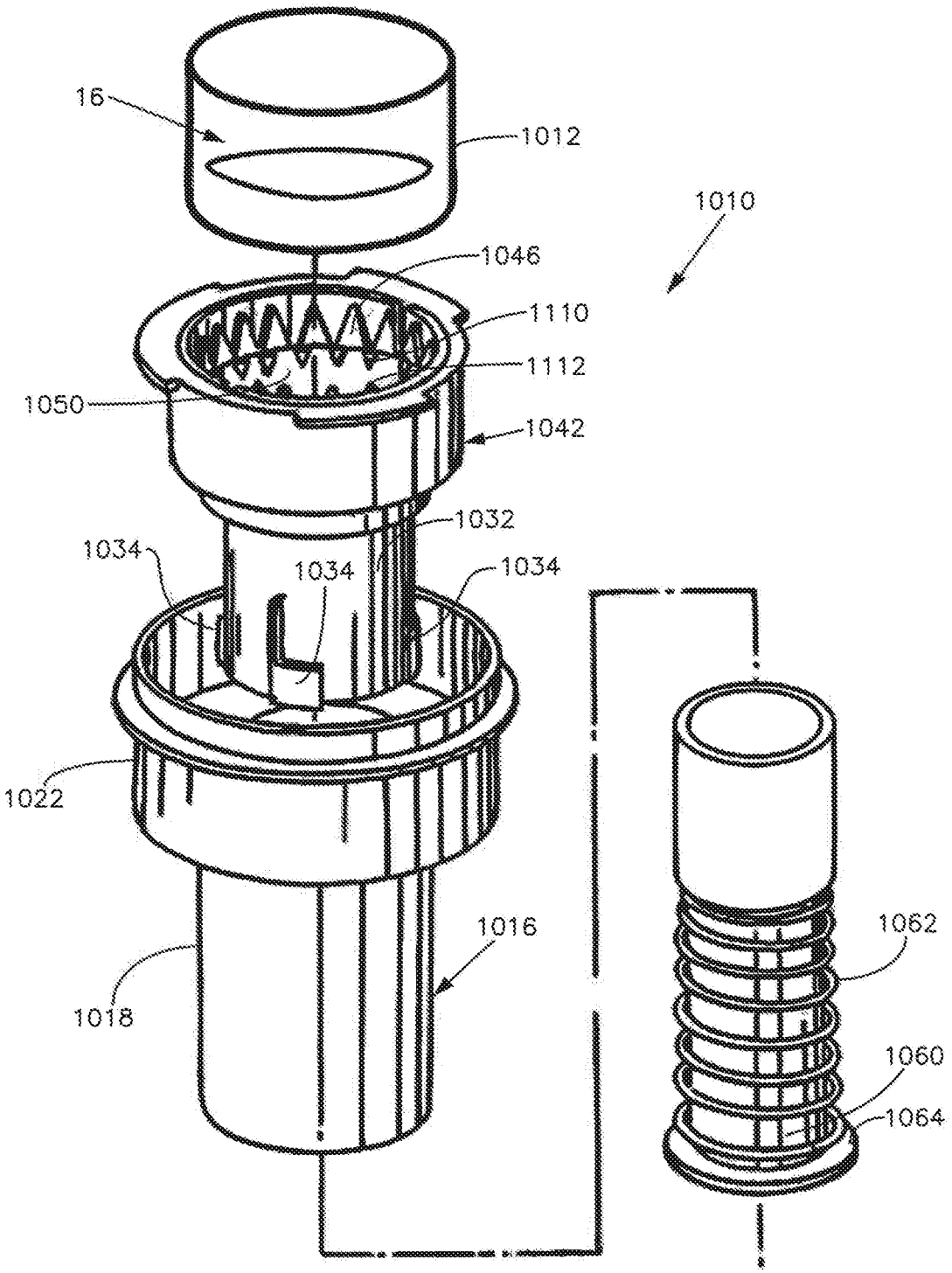
FIG. 17D is a top perspective, exploded view of the cleaning head illustrated in FIGS. 17A and 17B.

FIG. 17D illustrates an exploded view of the nozzle assembly 1010. As illustrated, sleeve 1060 may include lugs cooperating with corresponding lugs in along a portion of the flow control device 1012 to function similarly to a bayonet fitting and lock the sleeve 1060 with the body 12.

Upon upward movement, the pin(s) 1070, 1072 will strike protrusion and be deflected to the right, or in the clockwise direction, as indicated. Such deflection will incrementally rotate flow control device 1012 clockwise. After the pin(s) 1070, 1072 passes protrusion, it will be guided to the right by the edge of saw tooth member 1046 until it reaches the junction between adjacent saw tooth members 1046. In particular embodiments, the degree of rotation of flow control device 1012 may be commensurate with the angular distance between the junction between adjacent saw tooth members 1048 and the junction between adjacent saw tooth members 1046. After water pressure within conduit 1020 ceases, coil spring 1062 causes retraction of sleeve 1060 and flow control device 1012. During such retraction, the pin(s) 1070,1072 moves vertically downwardly, as represented by arrow 1116, until it strikes an edge of protrusion 1112. This protrusion 1112 will guide the pin 1070,1072 adjacent an edge of saw tooth members 1048 until it comes to rest at the junction between the two adjacent saw tooth members 1048.

In particular embodiments, saw tooth members 1046 may be offset from saw tooth members 1048 by one-half of the width of the saw tooth members 1046, 1048, when saw tooth members 1046, 1048 have substantially identical dimensions. In other particular embodiments, the degree of rotation of the flow control device 1012 during each incremental rotation step may be governed by the dissimilarly between the relative dimensions of the saw tooth members 1046, 1048, e.g., the flow control device 1012 may rotate more on its way down rather than on its way up.

As illustrated, the pin(s) 1070, 1072 will move upwardly from in between saw tooth members 1048 commensurate with upward movement of flow control device 1012 upon the presence of water pressure within conduit 1020. As the pin 1070, 1072 moves upwardly, it will contact protrusion and be directed to the left, or counterclockwise, (not to the right as formerly described). Thereafter, the pin(s) 1070, 1072 will slide along the edge of saw tooth members 1046 until reaching the junction between adjacent saw tooth members 1046. Upon cessation of water pressure within conduit 1020, sleeve 1060 and flow control device 1012 will retract and the pin(s) 1070, 1072 will move until it strikes the edge of protrusion 1112. This edge will guide the pin(s) 1070, 1072 onto the edge of a saw tooth member 1048 until it bottoms out at the junction between adjacent saw tooth members 1048; this position corresponds with the retracted position of sleeve 1060 and flow control device 1012. The resulting incremental rotation of flow control device 1012 will continue until the other edge of cam pattern 1080 contacts and causes rotational movement of roundel 1054 to relocate the cam reverser 1050.

Figure 18B:
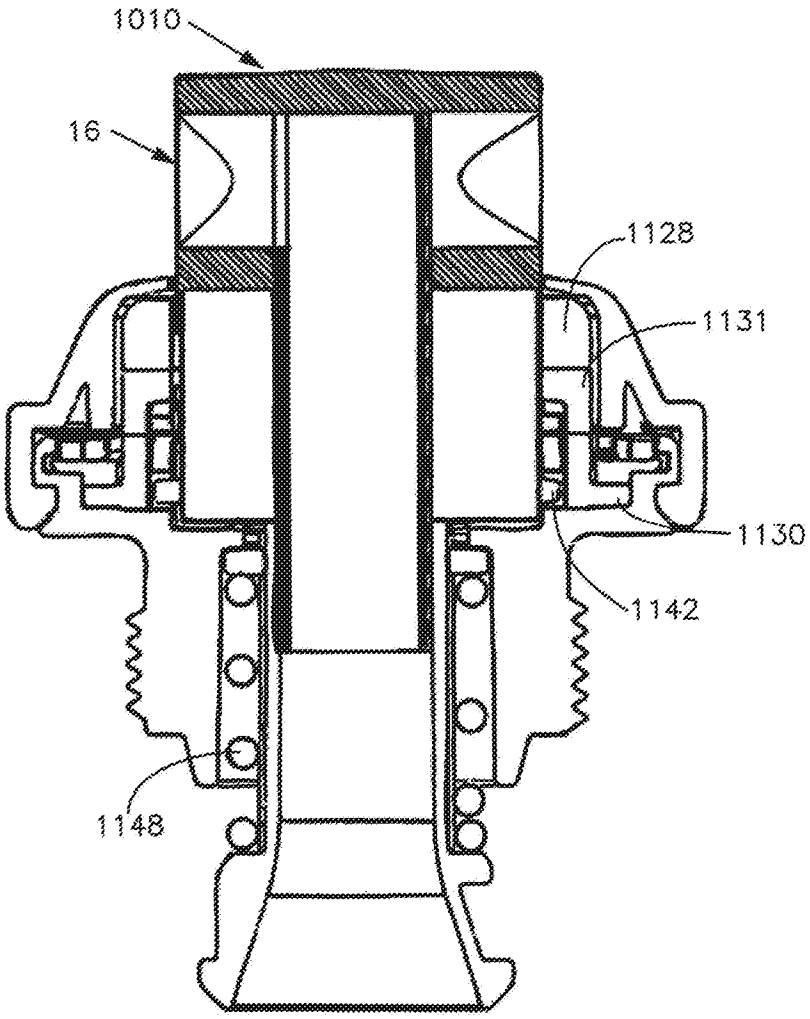
FIG. 18A and FIG. 18B are sectional views of the nozzle assembly illustrated in FIG. 18A in a closed configuration and an open configuration, respectively, according to an embodiment of the present disclosure.
Figure 18A:
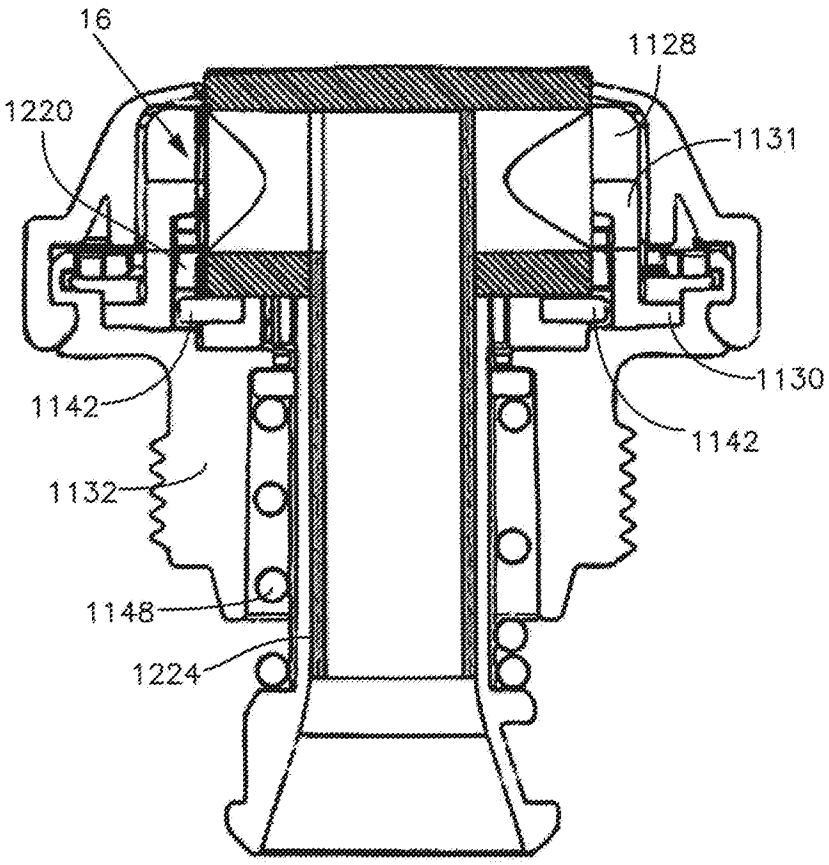
Figure 18C:
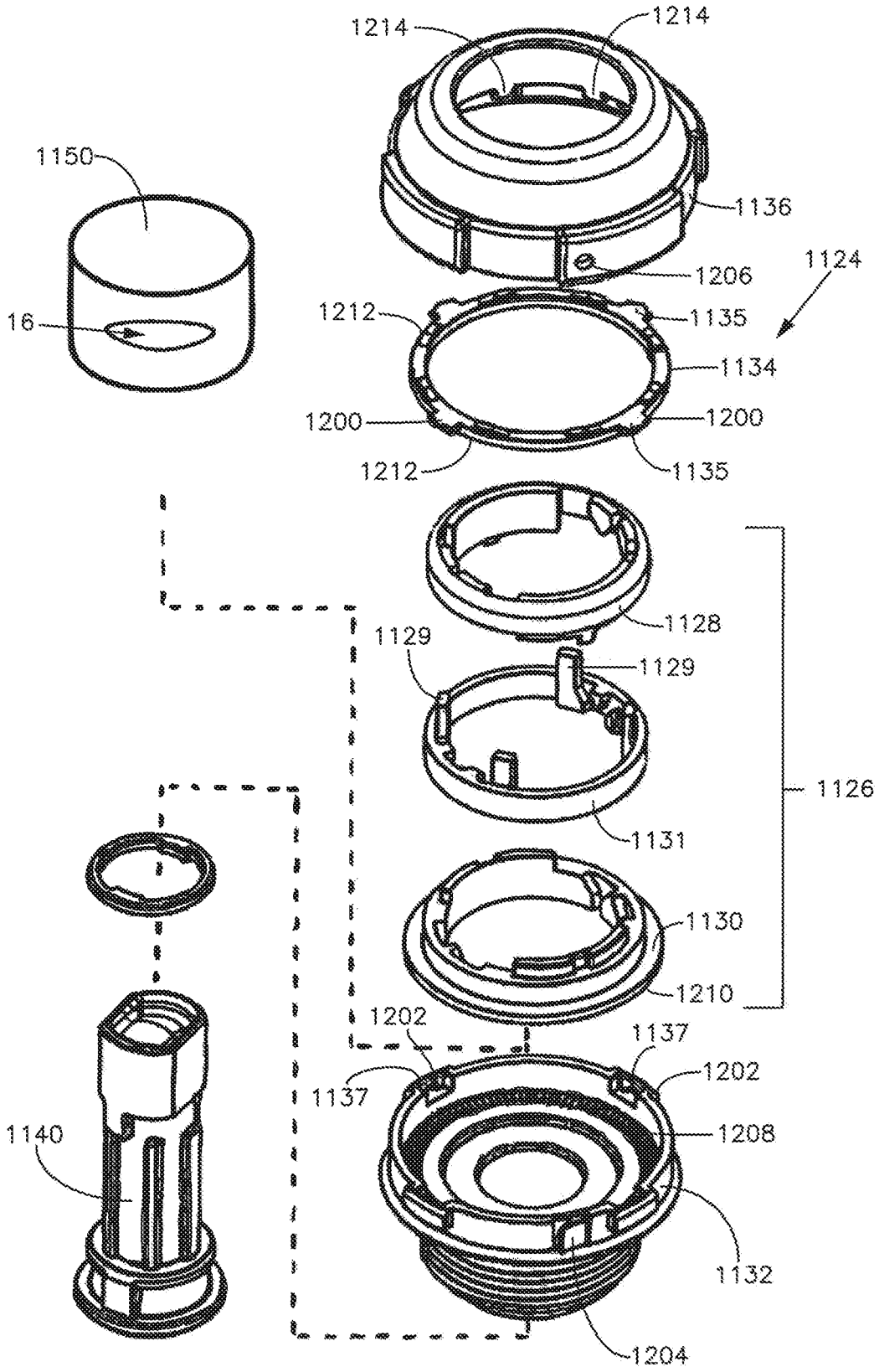
FIG. 18C is a top perspective exploded view of a nozzle assembly according to an embodiment to of the present disclosure.

FIGS. 18A through 18C illustrate an embodiment of a cleaning head assembly (alternatively called a nozzle assembly) 1124. The cleaning head assembly 1124 includes a flow control device 1150. The cleaning head assembly 1124 is configured to transition between an open configuration and a closed configuration as illustrated in FIGS. 18A and 18B.

Referring to FIG. 18C, an exploded view of another embodiment of a cleaning head assembly (alternatively called a nozzle assembly) 1124 is illustrated. The cleaning head assembly 1124 may include a cam assembly (alternatively called a cam ring) 1126. As illustrated, in particular embodiments the cam assembly 1126 may include an upper section 1128, a slidable section 1131 (alternatively called a cam reverser), and a lower section 1130. The slidable section 1131 may include at least one shifter 1129 that extends from the slidable section into the upper section 1128. The cam assembly 1126 may couple into a housing (alternatively called a body) 1132. When coupled into the housing 1132, a locking ring 1134 may be coupled over the lower section 1130 and includes lugs 1135 that engage within locking features 1137 in the housing 1132. In particular embodiments, the upper section 1128 and lower section 1130 of the cam assembly 1126 may be fixedly coupled together through, by non-limiting example, a sonic weld, heat staking, adhesive or other method of fixedly coupling two plastic parts together. While the upper section 1128 and lower section 1130 are fixedly coupled together, the slidable section 1131 remains slidably engaged between them and is free to move rotatably with respect to the upper and lower sections 1128, 1130, respectively.

The tips of the lugs 1135, of the particular embodiment shown in FIG. 18C, are configured with prongs 1200 that fit into the recesses 1202 of the locking features 1137 in the housing 1132. Placement of the locking ring 1134 over the cam assembly 1126 in the lower section 1130 holds the cam assembly 1126 in place through mating of the prongs 1200 with the recesses 1202. In many cases, the strength of the engagement of the prongs 1200 into the recesses 1202 is strong enough that the up and down action in the cam assembly 1126 so that the flow control device 1140 may be tested without the cap ring 1136 added. This allows an installer to rotationally adjust the cam assembly 1126 in relation to the lower section 1130 prior to locking all of the components in place with the cap ring 1136. By rotationally adjusting the cam assembly 1126 in relation to the lower section 1130, the directional orientation of the flow control device 1140 may be set regardless of the original orientation of the in-wall fitting for the nozzle assembly. In other words, even though the in-wall fitting for the nozzle assembly yields an unknown radial direction for the final body 12, an installer can adjust the direction of the flow control device during installation to any orientation needed.

A cap ring 1136 may be coupled over the cam assembly 1126 against the locking ring 1134. Use of the cap ring 1136 may allow, in particular embodiments, for the lower and upper sections 1130, 1128 of the cam assembly 1126 to be rendered substantially immobile in relation to the housing 1132 during operation of the cleaning head assembly 1124 while leaving the slidable section 1131 capable of rotational sliding motion. The cap ring 1136 may be loosened or removed by pressing a locking arm 1204 coupled to the housing 1132 which is engaged with the cap ring 1136 inwardly through an opening 1206 in the cap ring 1136 until the locking arm 1204 disengages from the cap ring 1136. The locking arm 1204 is biased to a position that engages the cap ring 1136. For example, the locking arm 1204 may be formed of a flexible material that self-biases the locking arm 1204. As another example, the locking arm 1204 may be formed as a lever with a spring, or through other structures known in the art for manufacturing a biased arm.

As illustrated in FIG. 18C, the ability of the cap ring 1136 to render the lower and upper sections 1128, 1130 of the cam assembly 1126 substantially immobile is aided, in particular embodiments, by a plurality of ridges 1208 distributed along the surface of the housing 1132 that couple with the lower section 1130 of the cam assembly 1126. As illustrated, the lower section 1130 includes a plurality of grooves 1210 that couple with the plurality of ridges 1208 of the housing 1132 under compressive force created by the rotation of the cap ring 1136. In particular embodiments, the compressive force generated by the rotation of the cap ring 1136 may be increased through a plurality of ramp members 1212 extending from the locking ring 1134 that engage with projections 1214 of the cap ring 1136 while it is rotated. As the cap ring 1136 is rotated, the force on the locking ring 1134 increases as the projections 1214 engage with the ramp members 1212, pressing the locking ring 1134 against the lower section 1130 of the cam assembly 1126. As the force against the lower section 1130 increases, the plurality of grooves 1210 begin to increasingly engage with the plurality of ridges 1208, thereby increasingly restricting the rotational motion of the lower section 1130 until it is rendered substantially immobile. In particular embodiments, once the cap ring 1136 has been rotated sufficiently to render the lower section 1130 immobile, the locking arm 1204 may engage with the cap ring 1136 to prevent any unintentional loosening of the cleaning head assembly 1124 thereby maintaining the positional relationship between the cam assembly 1126 and the housing 1132.

As illustrated in FIG. 18C, embodiments of a cleaning head assembly 1124 may include a stem (sleeve) 1140 that extends through the housing 1132 and the cam assembly 1126. In the particular embodiment illustrated in FIG. 18C, the stem 1140 comprises at least one pin 1142 that extends from a side of a head 1150 that couples over the top of the stem 1140. In other embodiments, the at least one pin 1142 (FIG. 18A) may couple to other components associated with the stem 1140 so that in either case (whether extending from the side of the head 1150 or from some other component associated with the stem 1140 or from the stem directly), the at least one pin 1142 can be said to extend from the stem 1140. In particular embodiments of a stem 1140, two or more pins 1142 may be included, and the relation between the direction the pin 1142 extends from the side of the stem 1140 relative to the opening 16 may range from about parallel to about perpendicular, depending upon system requirements. The pin 1142 for these embodiments engages with the cam assembly 1124 within the upper section 1128, the slidable section 1131, and the lower section 1130, as illustrated in FIG. 18A. In particular embodiments, the pin 1142 may contact the edges of a plurality of saw teeth 1146 within the cam assembly 1126. The stem 1140 may further include a spring element (coil spring) 1148 (shown on FIG. 18A) configured to provide bias force against the stem 1140 when it is extended from the housing 1132. FIG. 18B illustrates the cleaning head assembly 1124 in an extended position, where the discharge opening 16 (similar to flow control device 10) is raised above an upper surface of the cap ring 1220 and the pin 1142 is engaged against a surface of the saw teeth 1220 in the upper section 6 of the cam assembly 1222. In the extended position, the stem 1224 is raised by water pressure force against the bias of the spring element 1148. FIG. 18B also illustrates a swimming pool wall 1226 with a threaded fitting 1228 mounted in the wall. The cleaning head assembly 1124 threadedly mates with the threaded fitting 1228 in this embodiment. Other coupling types are known four coupling a cleaning head assembly to a wall fitting and may equivalently be used in place of the threaded fitting shown here.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may affect numerous modifications to the invention as described herein, and changes may be made without departing from the scope and spirit of the invention as defined by the appended claims.

What is claimed:

1. A nozzle assembly, comprising:

a housing configured to be mounted at least partially in a wall of a pool, the housing including an outer wall that extends along an axis, and a channel at least partially defined by the outer wall and that extends through the housing along the axis; and a flow control device at least partially disposed in the channel, the flow control device including a body that has a first elliptical opening, a second elliptical opening, an elliptical shaped passage that extends from the first elliptical opening to the second elliptical opening, and an inlet port, the flow control device further including a nozzle disposed in the inlet port such that nozzle extends across the elliptical shaped passage between the first elliptical opening and the second elliptical opening, the nozzle having an exit port that is disposed in the elliptical shaped passage, and the inlet port of the nozzle is positioned to receive therethrough a fluid, wherein the housing is configured to transition the flow control device between an open configuration where the elliptical shaped passage of the flow control device is unobstructed by the housing and a closed configuration where passage of the flow control device is obstructed by the outer wall of the housing.

2. The nozzle assembly of claim 1, wherein the flow control device includes a stem that is coupled to the nozzle, the stem extending at least partially through the channel.

3. The nozzle assembly of claim 1, wherein the flow control device is configured to automatically transition between the closed configuration and the open configuration in response to a flow of fluid entering the channel.

4. The nozzle assembly of claim 1, wherein the flow control device is configured to move along the axis to transition from the closed configuration into the open configuration.

5. The nozzle assembly of claim 1, wherein the flow control device is configured to translate along the axis.

6. The nozzle assembly of claim 1, wherein the flow control device is configured to rotate about the axis as it is moving along the axis to transition between the open configuration and the closed configuration.

7. The nozzle assembly of claim 1, wherein the flow control device is configured to reciprocate about the axis.

8. The nozzle assembly of claim 1, wherein as the flow control device reciprocates about the axis, the flow control device transitions into the open configuration.

9. The nozzle assembly of claim 1, wherein the flow control device is configured to reciprocate about the axis when in the open configuration.

10. The nozzle assembly of claim 1, wherein the body defines an inner surface, the inner surface having a convergent portion and a divergent portion, and at least one of the convergent portion and the divergent portion of the inner surface is tapered with respect to a central axis of the flow control device that extends through the passage.

11. The nozzle assembly of claim 10, wherein the divergent portion is oriented along a direction that is angularly offset with respect to the axis.

12. The nozzle assembly of claim 10, wherein the divergent portion is oriented along a direction that is angularly offset with respect to the axis.

13. The nozzle assembly of claim 1, further comprising an actuation member that is configured to transition the flow control device between the open configuration and the closed configuration.

14. The nozzle assembly of claim 13, wherein the actuation member is a spring that biases the flow control device into the closed configuration, wherein when the spring is compressed, the flow control device is in the open configuration.

15. The nozzle assembly of claim 13, wherein the actuation member is a threaded body, wherein rotation of the threaded body about the axis cause the flow control device to transition between the closed configuration and open configuration.

16. The nozzle assembly of claim 13, wherein the actuation member is a ratchet.

17. The nozzle assembly of claim 1, wherein the flow control device is configured to transition between the open configuration and the closed configuration via a weight.

18. The nozzle assembly of claim 1, wherein the body has an inner surface, an outer surface opposed to the inner surface, the outer surface of the body further defining an inlet port disposed between the first elliptical opening and the second elliptical opening, the inner surface including a constriction in the passage disposed between the first elliptical opening and the second elliptical opening.

19. The nozzle assembly of claim 18, wherein the constriction extends into the passage.

20. The nozzle assembly of claim 18, wherein the constriction is aligned with the exit port of the nozzle.

21. The nozzle assembly of claim 18, wherein the constriction is spaced from a plane aligned with the exit port of the nozzle in a downstream direction toward the second elliptical opening.

22. The nozzle assembly of claim 18, wherein the constriction is spaced from a plane aligned with the exit port of the nozzle in an upstream direction toward the first elliptical opening.

23. A nozzle assembly, comprising:

a housing configured to be coupled to a conduit that is configured to convey fluid into the housing;

a spring-loaded sleeve slidingly attached to the housing, the spring-loaded sleeve extending along a longitudinal axis, the spring-loaded sleeve being configured to slide along the longitudinal axis in a first direction in response to sufficient fluid pressure within the conduit and to retract along the longitudinal axis in a second direction that is opposite to the first direction in the absence of the sufficient fluid pressure within the conduit; and a flow control device coupled to the spring-loaded sleeve, the flow control device including a body that has a first elliptical opening, a second elliptical opening, an elliptical shaped passage that extends from the first elliptical opening to the second elliptical opening, and an inlet port, the flow control device including a nozzle disposed in the inlet port such that the nozzle extends across the elliptical shaped passage, the nozzle including an exit port that is disposed in the passage.

24. The flow control device of claim 23, where the housing further comprises a plurality of channels and the spring-loaded sleeve further comprises a plurality of guides that are configured to slidingly engage the plurality of channels on the housing to rotate the spring-loaded sleeve in a first direction as the spring-loaded sleeve slides along the longitudinal axis.

25. The nozzle assembly of claim 23, wherein the body has an inner surface, an outer surface opposed to the inner surface, the outer surface of the body further defining the inlet port disposed between the first elliptical opening and the second elliptical opening, the inner surface including a constriction in the passage disposed between the first elliptical opening and the second elliptical opening.

26. The nozzle assembly of claim 25, wherein the constriction extends into the passage.

27. The nozzle assembly of claim 25, wherein the constriction is aligned with the exit port of the nozzle.

28. The nozzle assembly of claim 25, wherein the constriction is spaced from a plane aligned with the exit port of the nozzle in a downstream direction toward the second elliptical opening.

29. The nozzle assembly of claim 25, wherein the constriction is spaced from a plane aligned with the exit port of the nozzle in an upstream direction toward the first elliptical opening.

* * * * *